US012630279B2

(12) United States Patent
Laflamme Lussier et al.

(10) Patent No.: US 12,630,279 B2
(45) Date of Patent: May 19, 2026

(54) PERSONAL WATERCRAFT WITH STEERING DAMPER

(71) Applicant: BOMBARDIER RECREATIONAL PRODUCTS INC., Valcourt (CA)

(72) Inventors: Karl Laflamme Lussier, Granby (CA); Jean-Philippe Gendron, Granby (CA); Benoit Larose, Mont-Saint-Hilaire (CA); Magali Bitsch, Saint-Francois-Xavier-de-Brompton (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 467 days.

(21) Appl. No.: 18/308,807

(22) Filed: Apr. 28, 2023

(65) Prior Publication Data

US 2024/0140580 A1 May 2, 2024

Related U.S. Application Data

(60) Provisional application No. 63/420,948, filed on Oct. 31, 2022.

(51) Int. Cl.
*B63H 25/02* (2006.01)

(52) U.S. Cl.
CPC ..... *B63H 25/02* (2013.01); *B63H 2025/022* (2013.01); *B63H 2025/024* (2013.01)

(58) Field of Classification Search
CPC ..... B63H 25/02; B63H 2025/022; B63H 2025/024
See application file for complete search history.

(56) References Cited

U.S. PATENT DOCUMENTS 6,892,666 B1 * 5/2005 Plante ..... B63B 34/10 114/364
7,315,779 B1 * 1/2008 Rioux ..... F02D 31/006 123/352

(Continued)

OTHER PUBLICATIONS https://www.fc-moto.de/epages/fcm.sf/?channable=020989696400313533383732353363735&ObjectPath=/Shops/10207048/Products/PB-100Y089T&Locale=en_CA&gclid=CjwKCAjwhNWZBhB_EiwAPzlhNnPGE72HXUbSEGSGdgZt71xyUzwOxpYShv0ScBKtpcSx8GFlpj_S9BoC8DEQAvD_BwE retrieved from fc-moto's website on Apr. 17, 2023.

(Continued)

*Primary Examiner* — S. Joseph Morano
*Assistant Examiner* — Jovon E Hayes
(74) *Attorney, Agent, or Firm* — BCF LLP

(57) ABSTRACT

A personal watercraft has: a hull; a deck, a straddle-type seat; a motor; a jet propulsion unit; a steering column support; a steering column pivotally connected to the steering column support; a handlebar connected to the steering column; a steering arm connected to the steering column; a push-pull cable connected between the steering arm and a nozzle arm of a steering nozzle of the jet propulsion unit; and a steering damper disposed between the handlebar and the steering column support. The steering damper has: a first portion connected to the steering column and being movable with the steering column; and a second portion connected to the steering column support, the steering column being pivotable relative to the second portion, the first portion being movable relative to the second portion, movement of the first portion relative to the second portion damping pivoting of the steering column about the steering column axis.

21 Claims, 26 Drawing Sheets

(56) References Cited

U.S. PATENT DOCUMENTS

| | | | | |
|---|---|---|---|---|
| D621,773 | S | 8/2010 | Norman | |
| 7,789,207 | B2 * | 9/2010 | Norman | B62K 21/08 280/272 |
| 7,841,915 | B2 * | 11/2010 | Bourret | B63H 11/107 440/41 |
| 8,408,572 | B2 * | 4/2013 | Sintorn | F16F 9/145 280/283 |
| 8,727,658 | B2 * | 5/2014 | Norman | B62K 21/08 188/290 |
| 9,896,111 | B2 * | 2/2018 | Azuma | B60W 10/18 |
| 11,643,175 | B2 * | 5/2023 | Araki | B63B 34/10 114/55.52 |
| 2005/0028718 | A1 * | 2/2005 | Bernier | B63H 25/02 114/144 R |
| 2005/0235894 | A1 * | 10/2005 | Hattori | B63B 34/10 114/144 R |
| 2006/0137586 | A1 * | 6/2006 | Yoshiki | B63B 1/22 114/55.52 |
| 2024/0239470 | A1 * | 7/2024 | Tian | B63B 34/10 |

OTHER PUBLICATIONS https://www.google.com/url?sa=i&url=https%3A%2F%2Fmotostarz.ca%2Fproducts%2Fgpr-v5s-stabilizer-steering-damper-2006-2021-yamaha-r6&psig=AOvVaw0c7TDpXh2h5sjPn8qKvolk&ust=1664552867630000&source=images&cd=vfe&ved=0CAwQjRxqFwoTCKjsj-esuvoCFQAAAAAdAAAAABAG retrieved from Motostarz's website on Apr. 17, 2023.

https://precision-rp.com/ELITE-DAMPER-MOUNT-KTM-525-450-505-ATV_p_27.html retrieved from Precision Racing Products' website on Apr. 17, 2023.

* cited by examiner

PERSONAL WATERCRAFT WITH STEERING DAMPER

REFERENCE TO RELATED APPLICATION

The present application claims priority to U.S. Provisional Patent Application No. 63/420,948, filed Oct. 31, 2022, the entirety of which is incorporated herein by reference.

FIELD OF TECHNOLOGY

The present technology relates to personal watercraft steering systems.

BACKGROUND

A personal watercraft (PWC) is a type of watercraft having a straddle-type seat and that is propelled by a jet propulsion system which ejects a jet of water to generate thrust. A PWC is steered via a handlebar that, when turned, pivots a steering nozzle that redirects the jet of water.

During operation, a PWC travels across water with waves that can be larger and more numerous than the bumps and potholes that would normally found on a road or an off-road trail. In contrast to motorcycles, cars, all-terrain vehicles (ATVs) and most other wheeled vehicles that have inflated tires and shock absorbers to cushion the vehicle and its driver from these variations in the road surface, most PWCs do not have any form of suspension other than the padding in the seats to cushion the driver from the movement of the hull of the PWC over the waves.

As a result, whether it is from small, repeated waves, such as what is known as "chop", from large, repeated large waves, such as what is know as "swell", or from individual waves, such as when crossing the wake of another craft, impacts on the hull are more readily transmitted to the rider compared to what a rider would feel while driving a wheeled vehicle over a bumpy road. Also, a driver of a PWC uses, among other things, the handlebar to help maintain his/her balance while riding. As such, while riding over a large wave or while riding at relatively high speed over chop, a PWC driver may involuntarily pivot the handlebar and cause some unwanted steering actions. While these steering actions are generally small and do not have a significant impact on the steering of the watercraft, there are certain riding conditions where a more precise steering is desired, such as in high performance operation and racing.

One solution consists in adding a suspension system to the PWC. This can be done by adding springs, shock absorbers and linkages between the hull and the deck of the PWC or by adding similar components between the seat and the deck of the PWC. In both cases, these are complex and relatively expensive components. They can also add significant weight, which is undesirable in racing conditions. Furthermore, many high performance and racing PWC drivers want to feel the waves through the PWC in order to react to changes in riding conditions, and a suspension system would take some of this away.

Therefore, there is a desire for a PWC that can overcome at least some of the above-described drawbacks.

SUMMARY

It is an object of the present technology to ameliorate at least some of the inconveniences present in the prior art.

According to one aspect of the present technology, there is provided a personal watercraft having: a hull; and a deck disposed on the hull. The deck defines: a pedestal at a lateral center of the deck; a left gunnel on a left side of the deck; a left footrest laterally between the left gunnel and the pedestal; a right gunnel on a right side of the deck; a right footrest laterally between the right gunnel and the pedestal; and a reboarding platform at least in part rearward of the pedestal. The hull and the deck define a volume therebetween. The personal watercraft also has a straddle-type seat connected to the pedestal; a motor disposed in the volume; and a jet propulsion unit operatively connected to and driven by the motor. The jet propulsion unit has: a jet pump; a venturi connected to the jet pump; and a steering nozzle pivotally connected to the venturi, the steering nozzle being pivotable about a steering nozzle axis to steer the personal watercraft, the steering nozzle having a nozzle arm. The personal watercraft also has a steering column support connected to the deck; a steering column pivotally connected to the steering column support, the steering column being pivotable about a steering column axis; a handlebar connected to an upper portion of the steering column; a steering arm connected to a lower portion of the steering column; a push-pull cable connected between the steering arm and the nozzle arm such that pivoting of the steering column about the steering column axis pivots the steering nozzle about the steering nozzle axis; and a steering damper disposed between the handlebar and the steering column support. The steering damper has: a first portion connected to the steering column and being movable with the steering column; and a second portion connected to the steering column support, the steering column being pivotable relative to the second portion, the first portion being movable relative to the second portion, movement of the first portion relative to the second portion damping pivoting of the steering column about the steering column axis.

In some embodiments of the present technology, the steering damper is a rotary steering damper; the first portion is a housing of the rotary steering damper; the housing being mounted to and pivoting with the steering column about the steering column axis; the second portion is a stator of the rotary steering damper; the stator is disposed in the housing; and the housing pivots relative to the stator about the steering column axis.

In some embodiments of the present technology, the steering column defines a receptacle; the receptacle is disposed between the handlebar and the steering arm; and the housing is received at least in part in the receptacle.

In some embodiments of the present technology, the receptacle has: a top wall; a bottom wall; a left side wall; a right side wall; and a rear wall. The top wall, the bottom wall, the left side wall and the right side wall define a generally forwardly facing opening.

In some embodiments of the present technology, the generally forwardly facing opening is generally pentagonal.

In some embodiments of the present technology, the left side wall and the right side wall extend rearward and laterally inward from the generally forwardly facing opening to the rear wall; and the housing tapers such that sides of the housing abut the left side wall and the right side wall.

In some embodiments of the present technology, the receptacle defines an aperture in a rear thereof; the rotary damper also has a damper arm connecting the stator to the steering column support; the damper arm extends rearward from the stator and through the aperture.

In some embodiments of the present technology, the aperture is a gap defined between the rear wall of the receptacle and the bottom wall of the receptacle In some embodiments of the present technology, the housing and the stator define a first variable volume chamber and a second variable volume chamber; and in response to pivoting of the housing relative to the stator, fluid flows between the first and second variable volume chambers.

In some embodiments of the present technology, the housing defines a sector-shaped chamber; the stator has a paddle extending in the sector-shaped chamber; the paddle separating the sector-shaped into the first variable volume chamber and the second variable volume chamber; the stator defines a first passage opening into the first variable volume chamber and a second passage opening into the second variable volume chamber; the first passage fluidly communicating with the second passage such that in response to pivoting of the housing relative to the stator, fluid flows between the first and second variable volume chambers via the first and second passages.

In some embodiments of the present technology, the stator defines an inner chamber fluidly communicating the first passage with the second passage; the rotary damper further comprises a flow limiter disposed in the inner chamber; and the flow limiter has at least a first position and a second position, the flow limiter restricting a flow of fluid between the first and second passages more in the first position than in the second position.

In some embodiments of the present technology, the inner chamber has a cylindrical wall; the flow limiter is a stepped cylinder having a first step and a second step; the first step is closer to the cylindrical wall than the second step; in the first position of the flow limiter, the first step is aligned with ends of the first and second passages opening into the inner chamber; in the second position of the flow limiter, the second step is aligned with the ends of the first and second passages opening into the inner chamber; and the stepped cylinder is turned between the first and second positions.

In some embodiments of the present technology, the rotary damper also has a damping level selector connected to the stepped cylinder to turn the stepped cylinder, the damping level selector being disposed on top of the housing.

In some embodiments of the present technology, the flow limiter has a third position, the flow limiter restricting a flow of fluid between the first and second passages more in the second position than in the third position.

In some embodiments of the present technology, the rotary damper also has a damper arm connecting the stator to the steering column support.

In some embodiments of the present technology, the damper arm extends rearward from the stator under the housing.

In some embodiments of the present technology, the fluid is hydraulic fluid.

In some embodiments of the present technology, the steering column defines a receptacle; the receptacle is disposed between the handlebar and the steering arm; and the steering damper is received at least in part in the receptacle.

In some embodiments of the present technology, the personal watercraft also has a front storage compartment in front of the steering column. The steering damper is forward of the straddle-type seat and rearward of the front storage compartment.

In some embodiments of the present technology, the personal watercraft also has a glove box longitudinally between the steering column and the straddle-type seat. The steering damper is forward of the glove box.

According to another aspect of the present technology, there is provided a personal watercraft having: a hull; and a deck disposed on the hull. The deck defines: a pedestal at a lateral center of the deck; a left gunnel on a left side of the deck; a left footrest laterally between the left gunnel and the pedestal; a right gunnel on a right side of the deck; a right footrest laterally between the right gunnel and the pedestal; and a reboarding platform at least in part rearward of the pedestal. The hull and the deck define a volume therebetween. the personal watercraft also has a straddle-type seat connected to the pedestal; a motor disposed in the volume; and a jet propulsion unit operatively connected to and driven by the motor. The jet propulsion unit has: a jet pump; a venturi connected to the jet pump; and a steering nozzle pivotally connected to the venturi, the steering nozzle being pivotable about a steering nozzle axis to steer the personal watercraft, the steering nozzle have a nozzle arm. The personal watercraft also has a steering column pivotally connected to the deck, the steering column being pivotable about a steering column axis; a handlebar connected to an upper portion of the steering column; a steering arm connected to a lower portion of the steering column; a push-pull cable connected between the steering arm and the nozzle arm such that pivoting of the steering column about the steering column axis pivots the steering nozzle about the steering nozzle axis, the steering column defining a receptacle between the handlebar and the steering arm, the receptacle having a generally forwardly facing opening; and a steering damper disposed at least in part in the receptacle. The steering damper has: a first portion connected to the steering column and being movable with the steering column; a second portion connected to the deck, the steering column being pivotable relative to the second portion, the first portion being movable relative to the second portion, movement of the first portion relative to the second portion damping pivoting of the steering column about the steering column axis; and a damping level selector adjusting a level of damping provided by the steering damper, the generally forwardly facing opening of the receptacle providing access to the damping level selector.

In the context of the present specification, unless expressly provided otherwise, the words "first", "second", "third", etc. have been used as adjectives only for the purpose of allowing for distinction between the nouns that they modify from one another, and not for the purpose of describing any particular relationship between those nouns.

It must be noted that, as used in this specification and the appended claims, the singular form "a", "an" and "the" include plural referents unless the context clearly dictates otherwise.

For purposes of the present application, terms related to spatial orientation when referring to a personal watercraft and components in relation to the personal watercraft, such as "vertical", "horizontal", "forwardly", "rearwardly", "left", "right", "above" and "below", are as they would be understood by a driver of the personal watercraft sitting thereon in an upright driving position, with the personal watercraft steered straight-ahead, at rest and being level.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
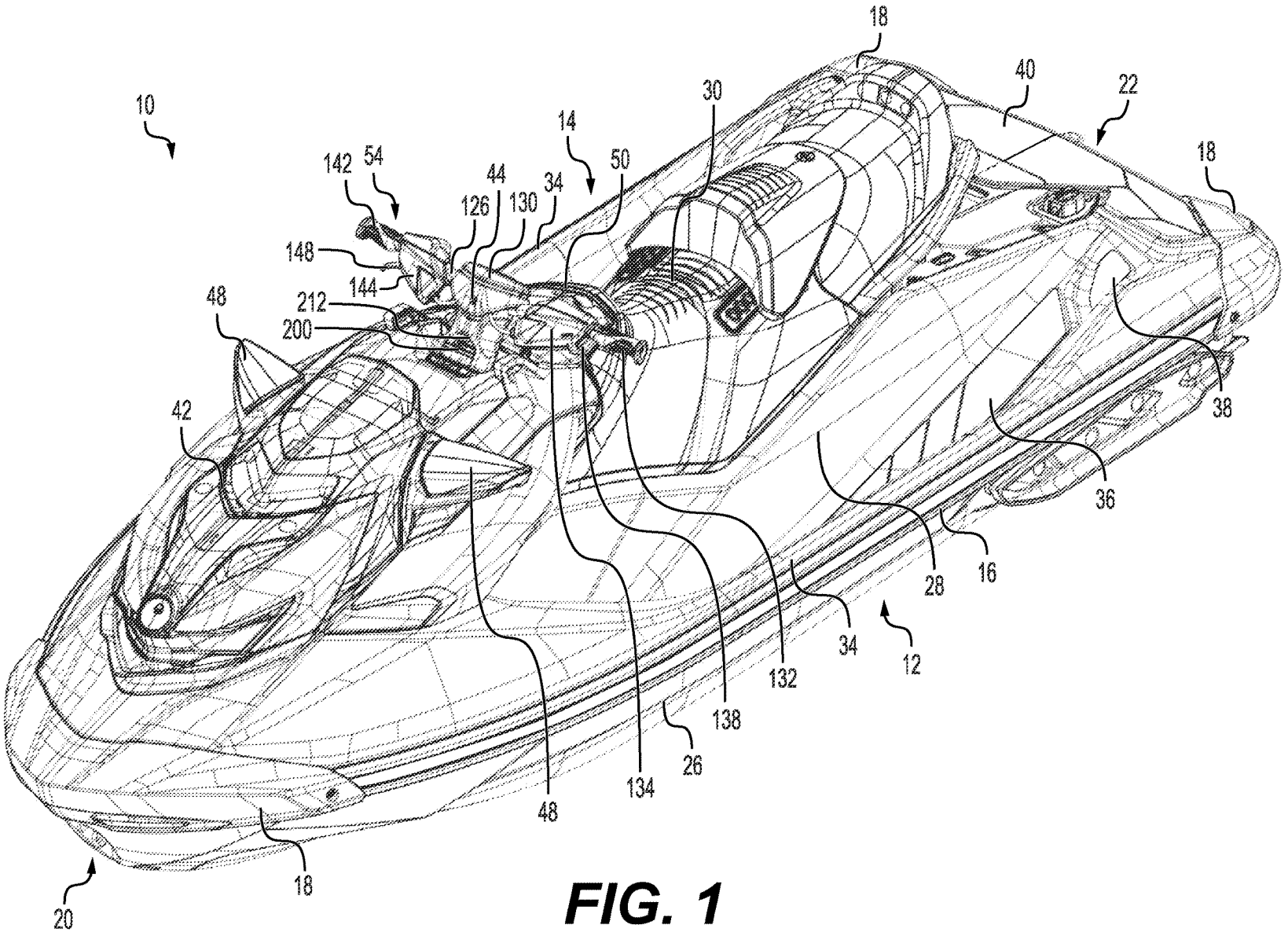
FIG. 1 is a perspective view taken from a front, left side of a PWC.

The present disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements.

Figure 2:
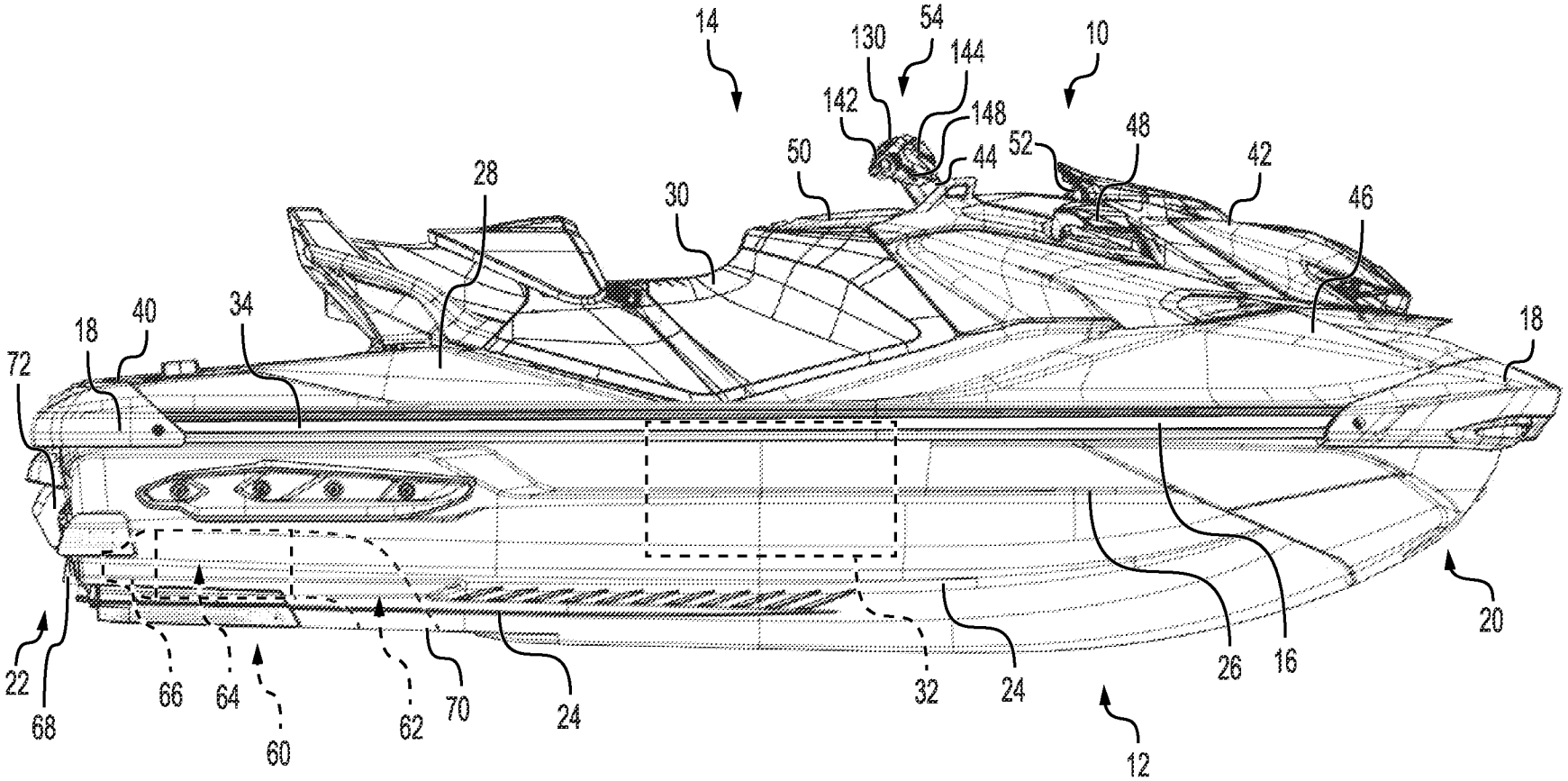
FIG. 2 is a right side elevation view of the PWC of FIG. 1.
Figure 3:
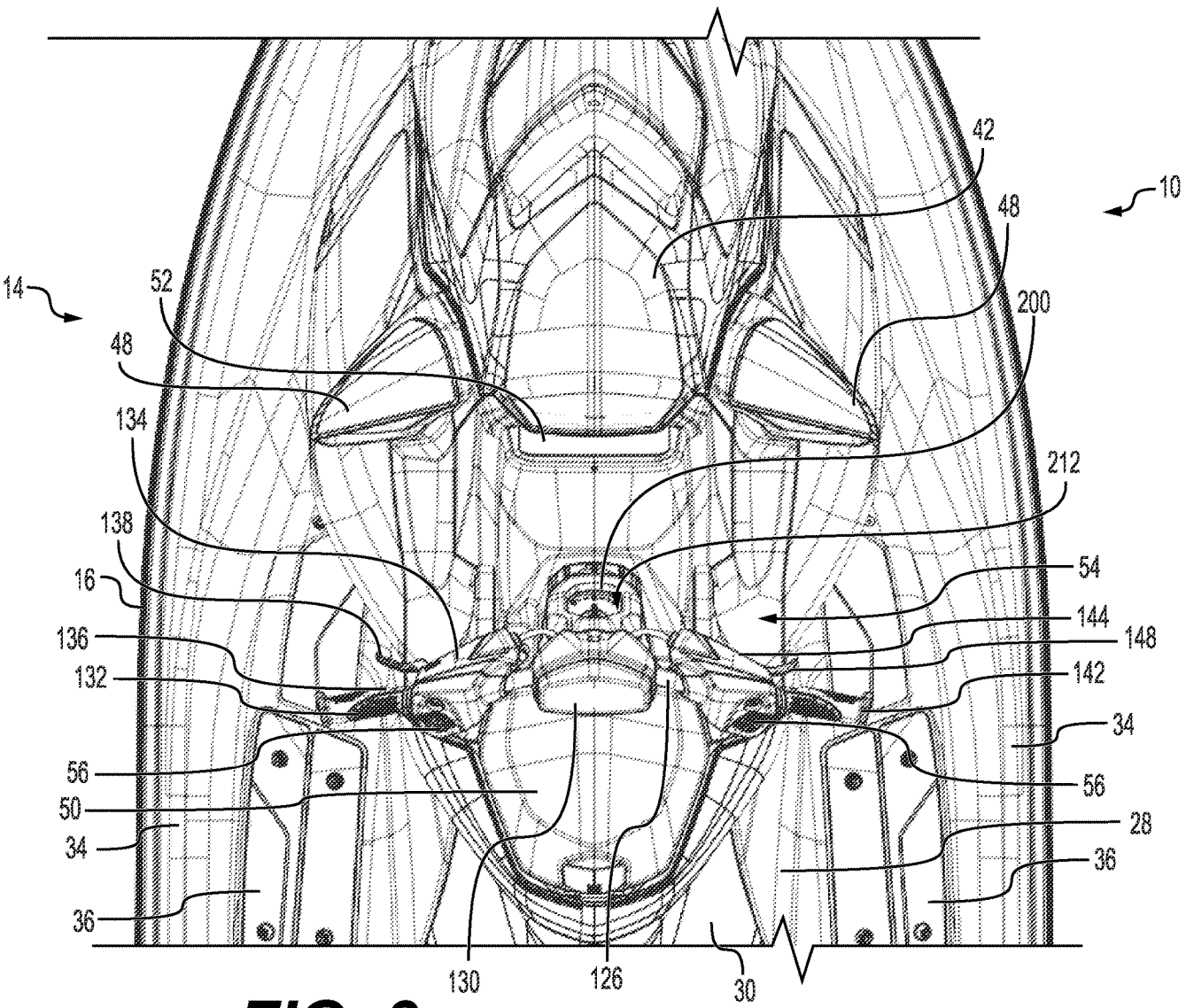
FIG. 3 is a top plan view of a handlebar region of the PWC of FIG. 1.

With reference to FIGS. 1 to 3 a personal watercraft (PWC) 10 has a hull 12 and a deck 14 disposed on the hull 12. The hull 12 buoyantly supports the PWC 10 in the water. The deck 14 is designed to accommodate one or multiple riders. The hull 12 and the deck 14 are joined together at a seam 16 that joins the parts in a sealing relationship. Bumpers 18 cover parts of the seam 16.

The hull 12 defines a bow 20 and a stern 22 opposite the bow 20. The hull 12 also has strakes 24 and chines 26 on each lateral side thereof. A strake 24 is a protruding portion of the hull 12. A chine 26 is the vertex formed where two surfaces of the hull 12 meet. The combination of strakes 24 and chines 26 provide the PWC 10 with some of its riding and handling characteristics.

A pedestal 28 is defined at a lateral center of the deck 14. A straddle-type seat 30 is connected on top of the pedestal 28 to accommodate multiple riders in a straddling position. A motor 32 (shown schematically in FIG. 2) is disposed in the volume defined between the hull 12 and the deck 14. The seat 30 covers a motor access opening defined by a top portion of the pedestal 28 to provide access to the motor 32.

The PWC 10 has left and right gunnels 34 disposed on the left and right sides of the deck 14 respectively. A left footrest 36 is defined laterally between the left gunnel 34 and the pedestal 28. A right footrest 36 is defined laterally between the right gunnel 34 and the pedestal 28.

The gunnels 34 are a pair of generally upwardly extending walls that help to prevent the entry of water in the footrests 36, provide lateral support for the riders' feet, and also provide buoyancy when turning the PWC 10, since the PWC 10 rolls slightly when turning. Towards the rear of the PWC 10, the gunnels 34 extend inwardly to act as heel rests 38. A passenger riding the PWC 10 facing towards the rear, to spot a water-skier for example, may place his or her heels on the heel rests 38, thereby providing a more stable riding position. Heel rests 38 could also be formed separately from the gunnels 34.

The footrests 36 are designed to accommodate the riders' feet in various riding positions. The footrests 36 are covered by carpeting made of a rubber-type material, for example, to provide additional comfort and traction for the feet of the riders.

A reboarding platform 40 is provided at the rear of the deck 14 to allow the rider or a passenger to easily reboard the PWC 10 from the water. Nonslip mats or some other suitable covering may cover the reboarding platform 40. A retractable ladder (not shown) may be affixed to the stern 22 to facilitate boarding the PWC 10 from the water onto the reboarding platform 40.

As seen in FIG. 1, the PWC 10 is provided with a hood 42 located forwardly of the seat 30 and of a steering column 44 of the PWC 10. A hinge (not shown) is attached between a forward portion of the hood 42 and the deck 14 to allow the hood 42 to move to an open position to provide access to a front storage bin 46 (schematically shown in FIG. 2). The hood 42 and the storage bin 46 together define a front storage compartment. A latch (not shown) located at a rearward portion of the hood 42 locks the hood 42 into a closed position. When in the closed position, the hood 42 prevents water from entering the front storage bin 24. Rearview mirrors 48 are positioned on either side of the hood 42 to allow the driver to see behind the PWC 10.

As seen in FIG. 3, the PWC 10 also has a glove box 50 disposed longitudinally between the steering column 44 and the seat 30. Even though it is called a glove box 50, it should be understood that the name glove box 50 designates a storage compartment intended to store small items, and not necessarily gloves.

As shown in FIG. 3, a display area or cluster 52 is located forwardly of the steering column 44. The display cluster 52 can be of any conventional display type, including a liquid crystal display (LCD), dials or LED (light emitting diodes). A handlebar assembly 54 connected to an upper portion of the steering column 44 has various buttons 56, which could alternatively be in the form of levers or switches, that allow the driver to modify the display data or mode (speed, engine rpm, time, etc.) on the display cluster 52 or to change a condition of the PWC 10, such as trim (i.e. the pitch of the PWC 10). The handlebar assembly 54 will be described in more detail below.

With reference to FIG. 2, the motor 32 drives a jet propulsion unit 60 which propels the PWC 10. In this embodiment, the motor 32 is an internal combustion engine 32 and will thus be referred to as the engine 32. The volume defined between the hull 12 and the deck 14 accommodates the engine 32, as well as a muffler, gas tank, electrical system (battery, electronic control unit, etc.), air box, the storage bin 46, and other elements required or desirable in the PWC 10. However, it is contemplated that, in alternative embodiments, the motor 32 may be any other suitable type of motor such as an electric motor. As will be understood, in such an embodiment, certain components would be added to or omitted from the PWC 10 (e.g., no muffler and gas tank, etc.).

The jet propulsion unit 60 pressurizes water to create thrust. The jet propulsion unit 60 has a duct in which water is pressurized and which is defined by various components of the jet propulsion unit 60, including an intake ramp 62, a jet pump 64, a venturi 66 and a steering nozzle 68. A driveshaft (not shown) is connected between the engine 32 and an impeller (not shown) provided in the jet pump 64. An inlet 70 of the jet propulsion unit 60 is positioned under the hull 12. When the jet propulsion unit 60 is in operation, water is first scooped into the inlet 70. An inlet grate (not shown) is positioned adjacent (i.e., at or near to) the inlet 70 and is configured to prevent large rocks, weeds, and other debris from entering the jet propulsion unit 60. It is contemplated that the inlet grate could be positioned in the inlet 70. Water flows from the inlet 70 through the intake ramp 62. The intake ramp 62 has a top portion that is formed by the hull 12 and a bottom portion that is formed by a ride shoe (not shown).

Figure 23:
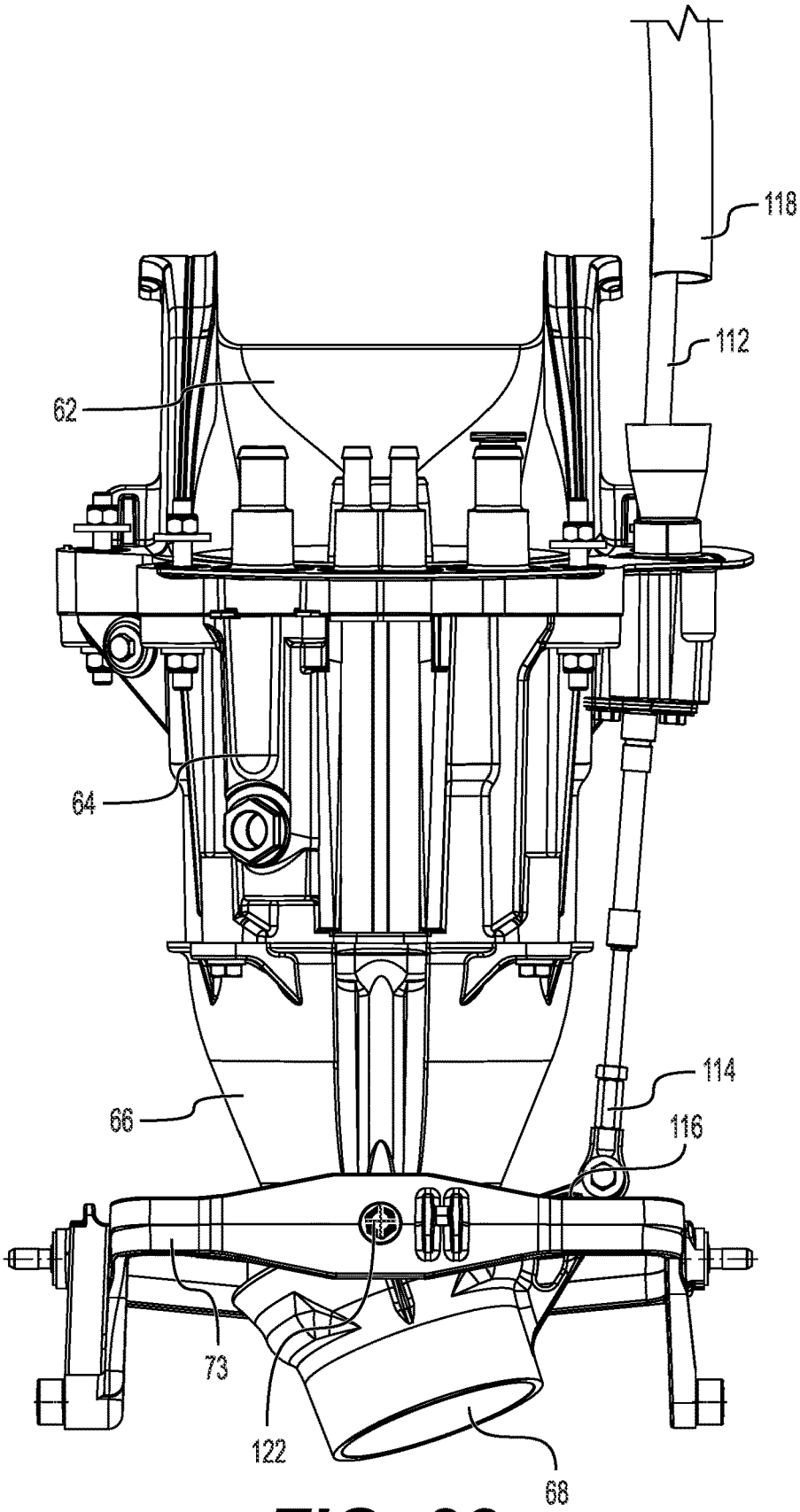
FIG. 23 is a top plan view of the portion the jet propulsion unit of FIG. 5, with the steering nozzle oriented to make the PWC make a right turn.

The PWC 10 is also provided with a reverse gate 72 (FIG. 2) which is movable between a stowed position where it does not interfere with the jet of water being expelled rearwardly by the jet propulsion unit 60 and a plurality of positions where it redirects the jet of water being expelled rearwardly by the jet propulsion unit 60. Notably, the reverse gate 72 can be actuated into a neutral position in which the thrust generated by the jet propulsion unit 60 does not have a longitudinal component such that the PWC 10 will not be accelerated or decelerated by the thrust and will stay in position if it was not moving prior to moving the reverse gate 72 in the neutral position. The reverse gate 72 can also be actuated into a reverse position in which it redirects the jet of water towards the front of the PWC 10, thus causing the PWC 10 to move in a reverse direction. A reverse gate actuator (not shown), in the form of an electric motor, is operatively connected to the reverse gate 72 to move the reverse gate 72. The reverse gate 72 is operatively connected to a support 73 (FIG. 23). Actuation of the reverse gate actuator pivots the reverse gate 72 about a horizontal axis relative to the support 73 and also pivots the support 73 about another horizontal axis relative to the venturi 66 to control a trim of the PWC 10. An example of a similar system is described in U.S. Pat. No. 7,841,915 B2, issued Nov. 30, 2010, the entirety of which is incorporated herein by reference. The reverse gate actuator could alternatively be any one of a mechanical, a hydraulic, or another type of electric actuator.

Figure 4:
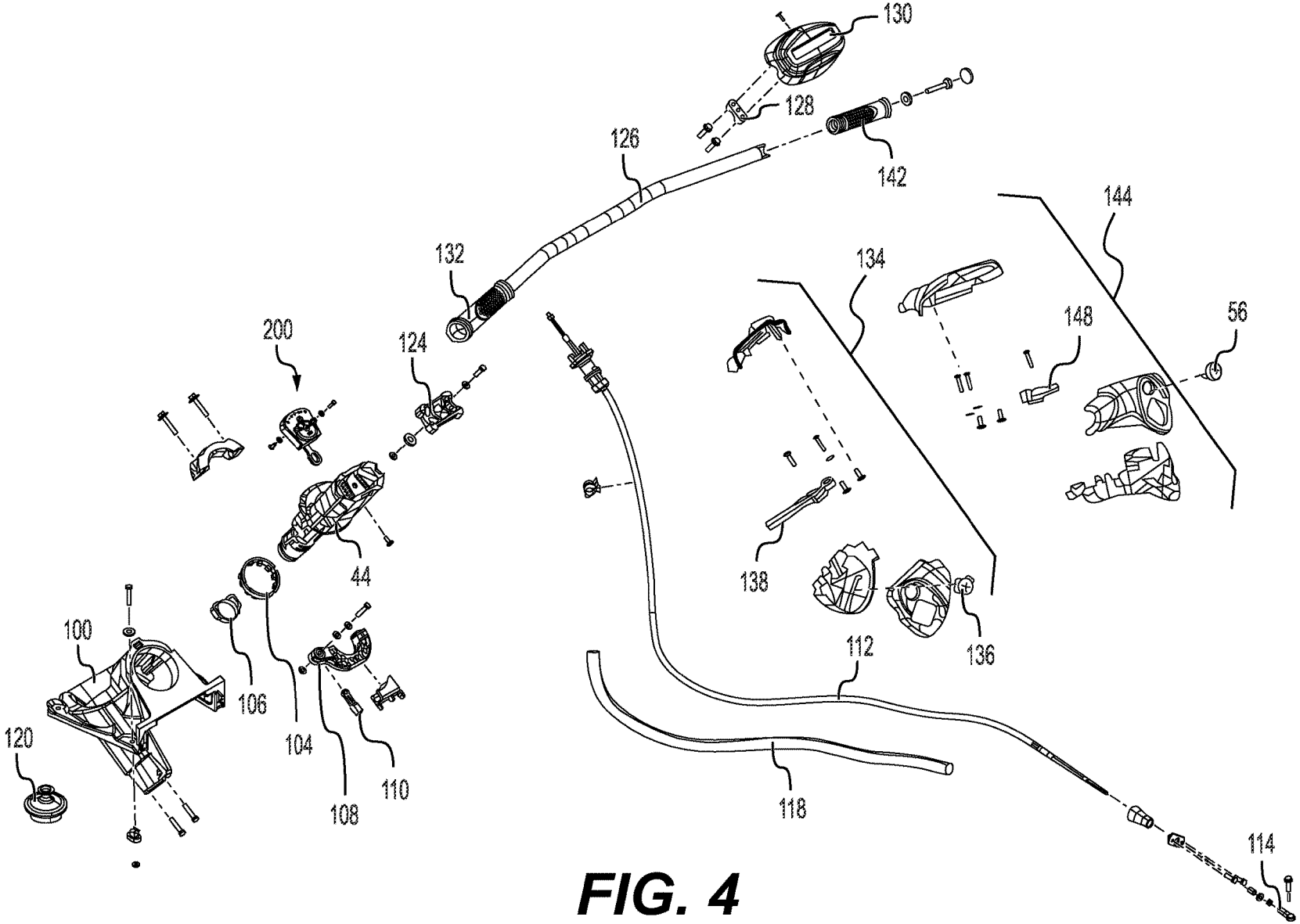
FIG. 4 is an exploded perspective view taken from a rear, left side of a portion of a steering system of the PWC of FIG. 1.
Figure 10:
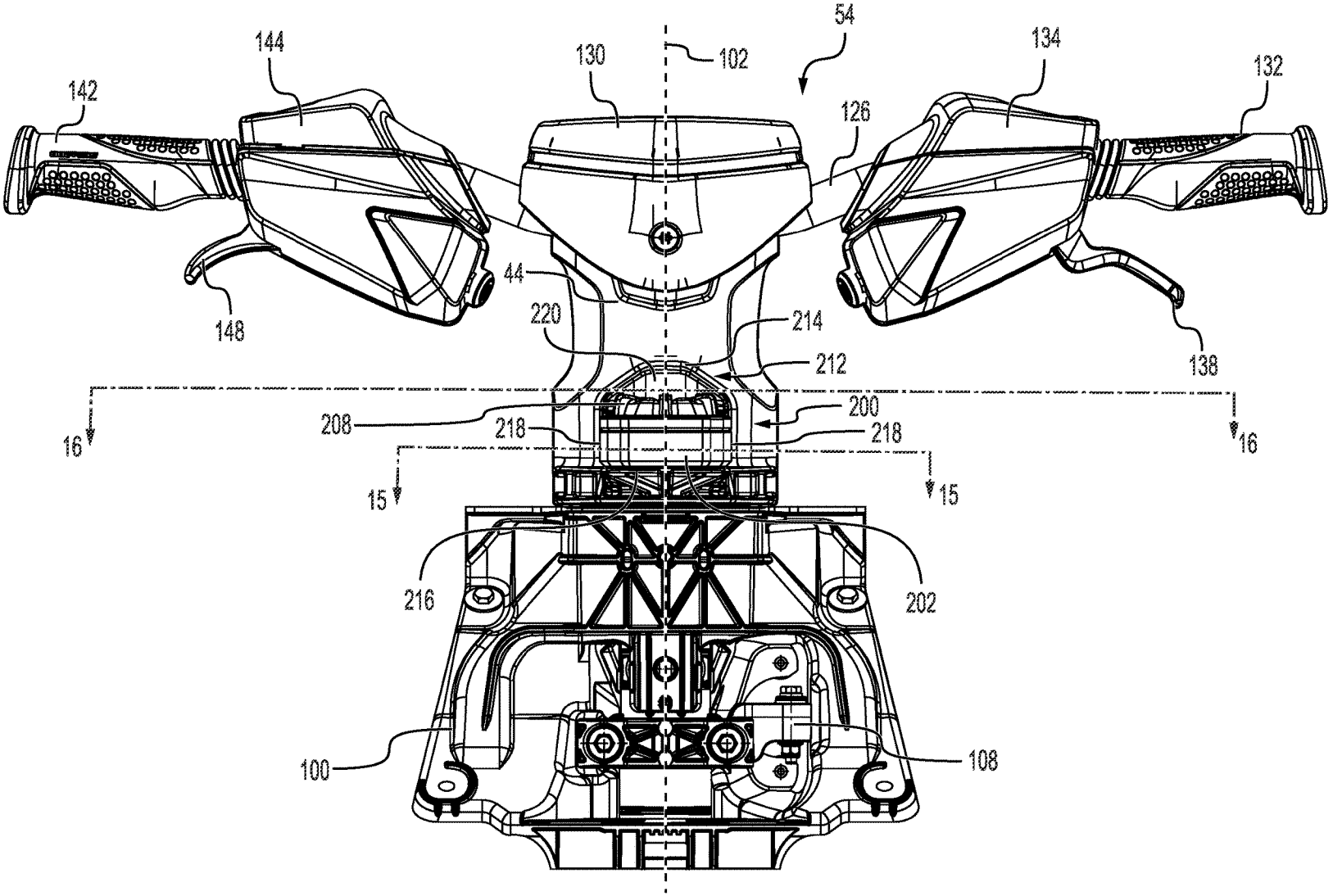
FIG. 10 is a perspective view taken from a top, front side of the portion of the steering system of FIG. 6.
Figure 11:
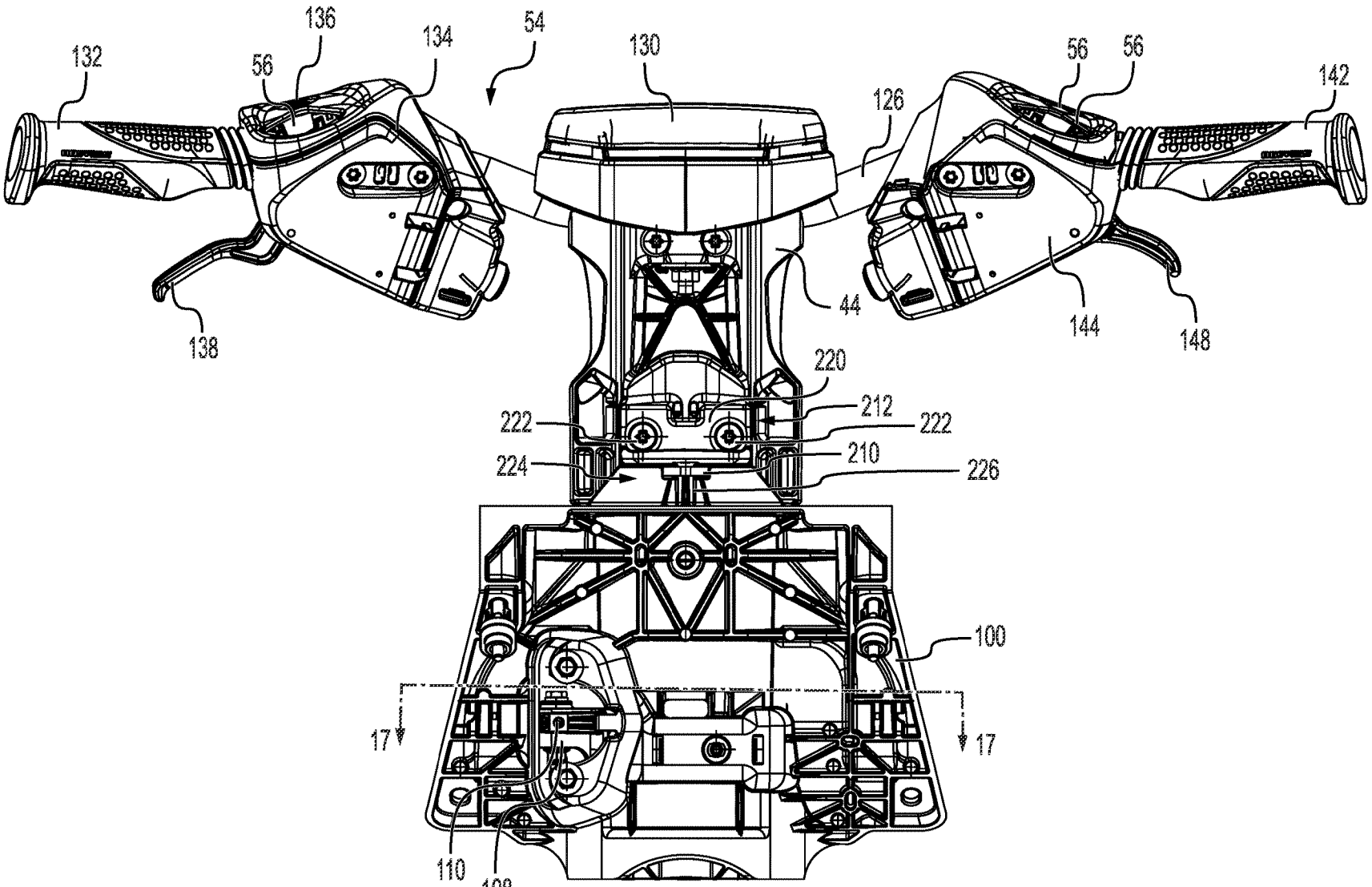
FIG. 11 is a perspective view taken from a bottom, rear side of the portion of the steering system of FIG. 6.
Figure 12:
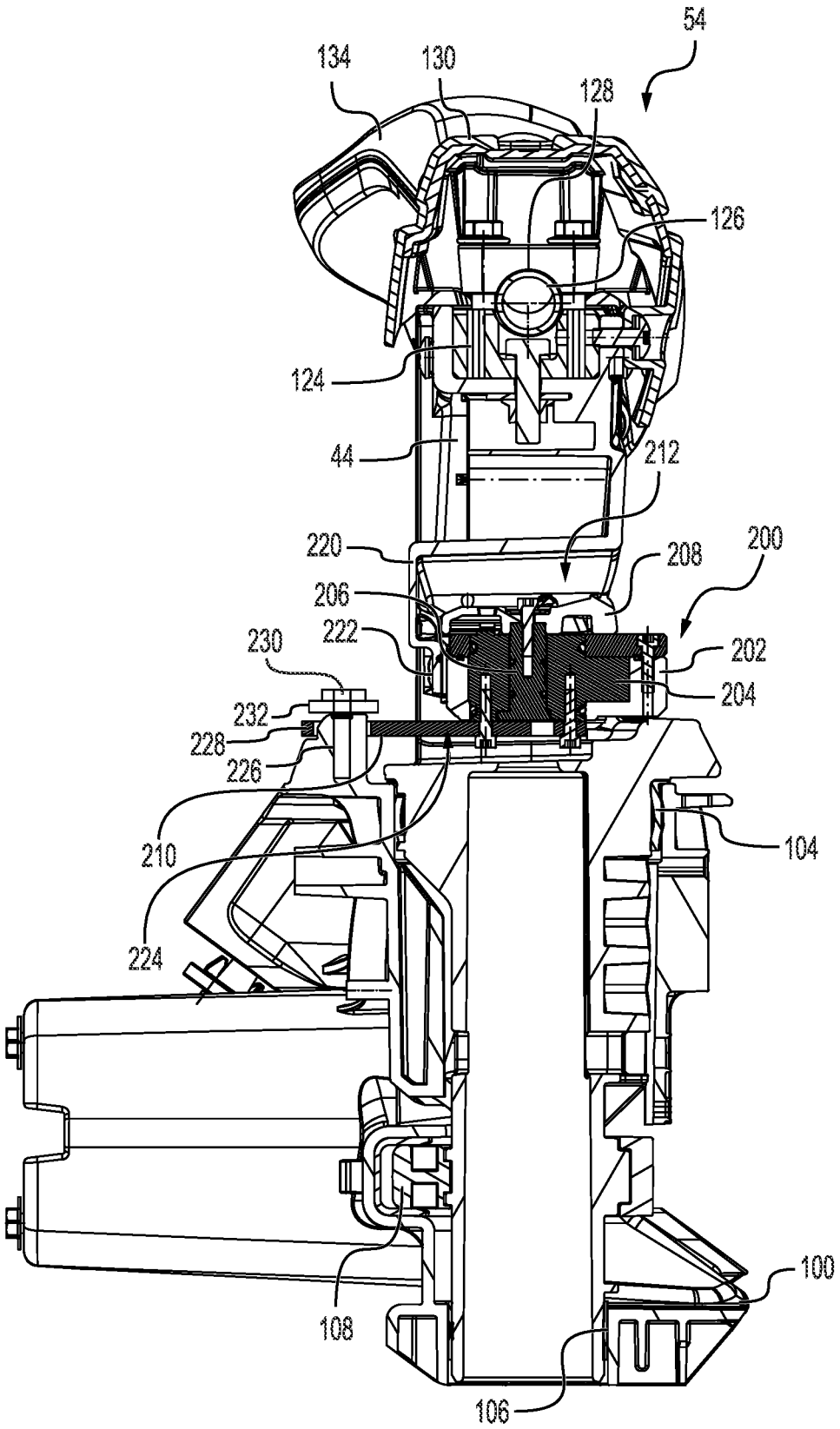
FIG. 12 is a cross-section of the portion of the steering system of FIG. 6 taken through line 12-12 of FIG. 9.
Figure 13:
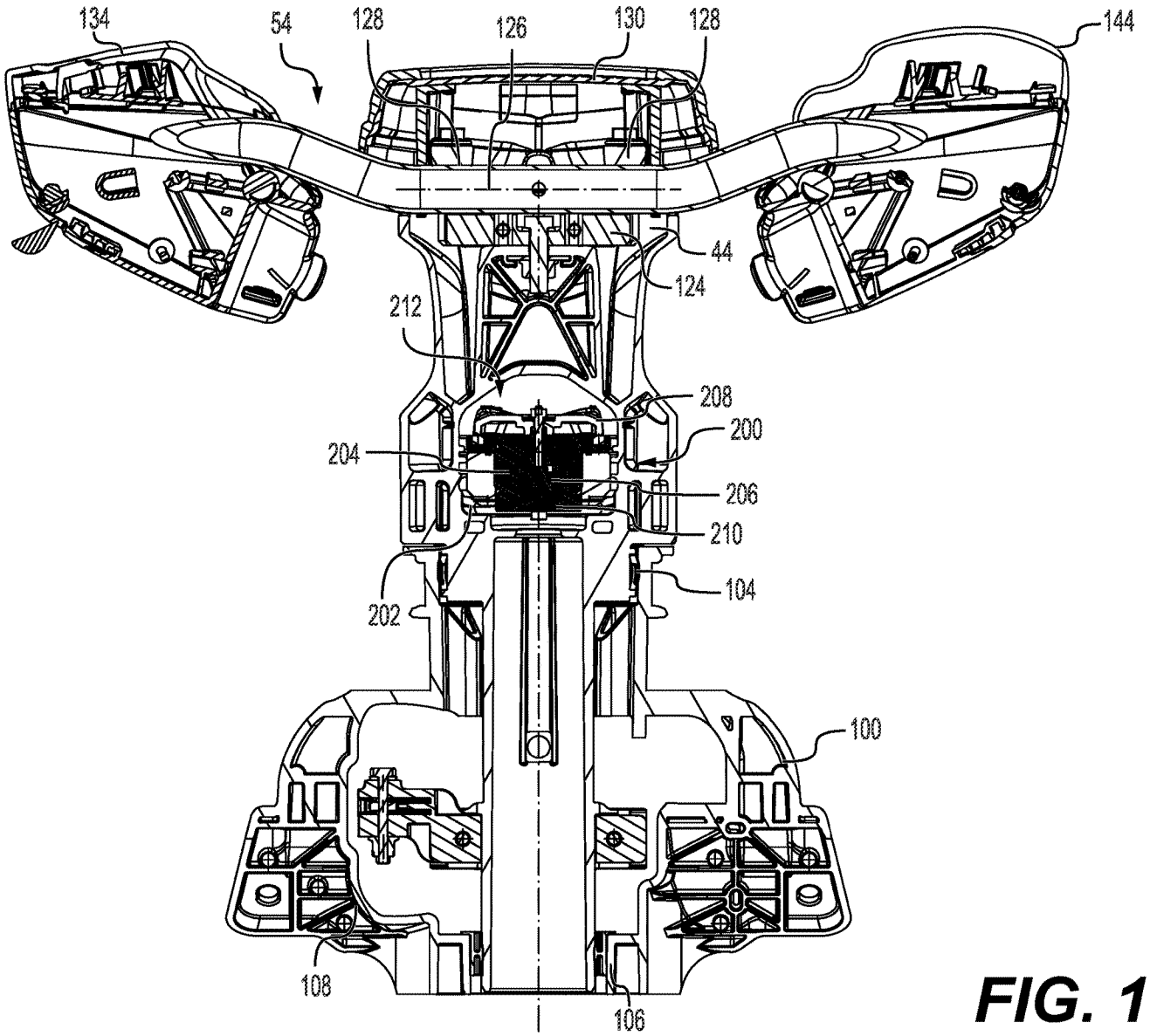
FIG. 13 is a cross-section of the portion of the steering system of FIG. 6 taken through line 13-13 of FIG. 8.
Figure 14:
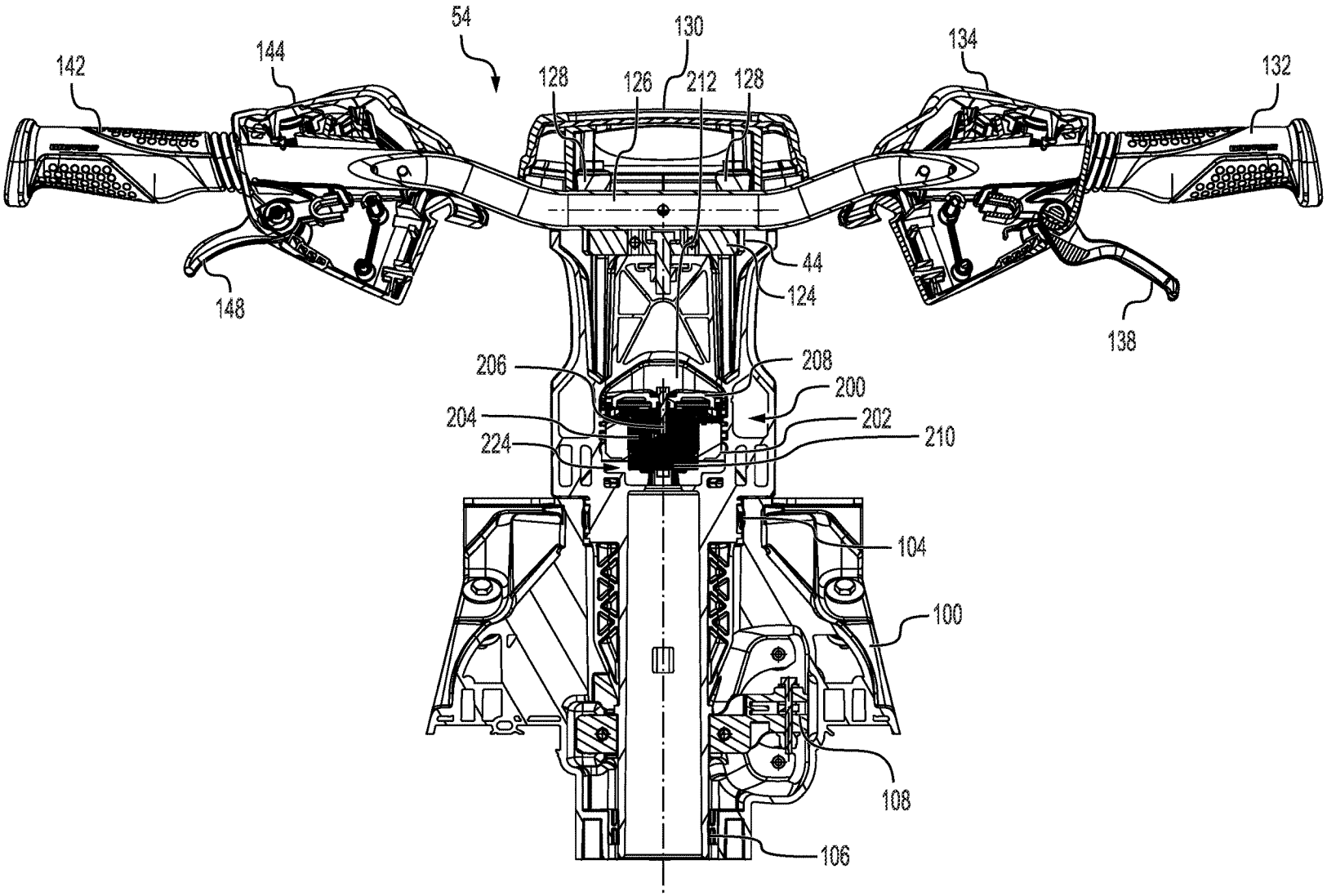
FIG. 14 is a cross-section of the portion of the steering system of FIG. 6 taken through line 14-14 of FIG. 8.

Turning now to FIGS. 4 to 23 a steering system of the PWC 10 will be described in detail. The steering system includes the above mentioned steering column 44 and handlebar assembly 54. A steering column support 100 is connected to the deck 14 at a position longitudinally between the seat 30 and the front storage bin 46. The steering column 44 is pivotally connected to the steering column support 100 so as to pivot about a steering column axis 102 (FIG. 10). With reference to FIG. 4, wear rings 104, 106 are provided between the steering column 44 and the steering column support 100. A steering arm 108 is connected to a lower portion of the steering column 44. A ball joint 110 is connected to the steering arm 108. A push-pull cable 112 has a front end connected to the ball joint 110. A rear end of the push-pull cable 112 is connected to another ball joint 114. The ball joint 114 is connected to a nozzle arm 116 (FIG. 5) of the steering nozzle 68. A corrugated sheath 118 is provided over the push-pull cable 112. A cable boot 120 is provided over the front portion of the push-pull cable 112 where the cable 112 enters the volume defined between the hull 12 and the deck 14 to prevent entry of water inside this volume. Since the push-pull cable 112 is connected between the steering arm 108 and the nozzle arm 116, pivoting the steering column 44 about the steering column axis 102 pivots the steering nozzle 68 about a steering nozzle axis 122 (FIG. 5) of the steering nozzle 68 as will be described in more detail below. The steering nozzle 68 is pivotally connected to the support 73 about the steering nozzle axis 122. As such, the steering nozzle 68 is pivotable relative to the support 73 about the steering nozzle axis 122 to steer the PWC 10, and also pivots up and down with the support 73 when the support 73 is moved by the reverse gate actuator to modify a trim of the PWC 10.

The handlebar assembly 54 has a handlebar support 124 fastened to the upper portion of the steering column 44. A handlebar 126 is received in a recess defined by the handlebar support 126. Two steering supports 128 (only one of which is shown in FIG. 4) are disposed over the handlebar 126 such that the handlebar 126 is held between the handlebar support 124 and the steering supports 128. The steering supports 128 are fastened to the handlebar support 124. A steering pad 130 is provided over a central portion of the handlebar 126.

A left handle grip 132 is disposed on the left portion of the handlebar 126. A left housing 134 is provided over the handlebar 126 laterally between the left handle grip 132 and the steering pad 130. Some of the buttons 56 and a PWC start/stop button 136 are provided on the left housing 134. A finger-actuated reverse lever 138 is pivotally connected to the left housing 134. The reverse lever 138 is used to control a position of the reverse gate 72. In some embodiments, the reverse lever 138 is also used to control a position of the reverse gate in combination with a speed of the engine 32 in order to decelerate the PWC 10. It is contemplated that the finger-actuated reverse lever 138 could alternatively be a thumb-actuated reverse lever pivotally connected to the left housing 134 or a lever pivotally connected to the deck 14 near the seat 30. It is also contemplated that other types of user inputs could be provided for actuating the reverse gate 72 and/or decelerating the PWC 10.

A right handle grip 142 is disposed on the right portion of the handlebar 126. A right housing 144 is provided over the handlebar 126 laterally between the right handle grip 142 and the steering pad 130. Some of the buttons 56 are provided on the right housing 144. A finger-actuated throttle lever 148 is pivotally connected to the right housing 144. The throttle lever 148 is used to control the engine 32, and therefore a speed of the PWC 10. It is contemplated that the throttle lever 148 could alternatively be a thumb-actuated throttle lever pivotally connected to the right housing 134 or a twisting portion of a twist-grip. It is also contemplated that other types of user inputs could be provided for controlling the speed of the PWC 10.

Figure 5:
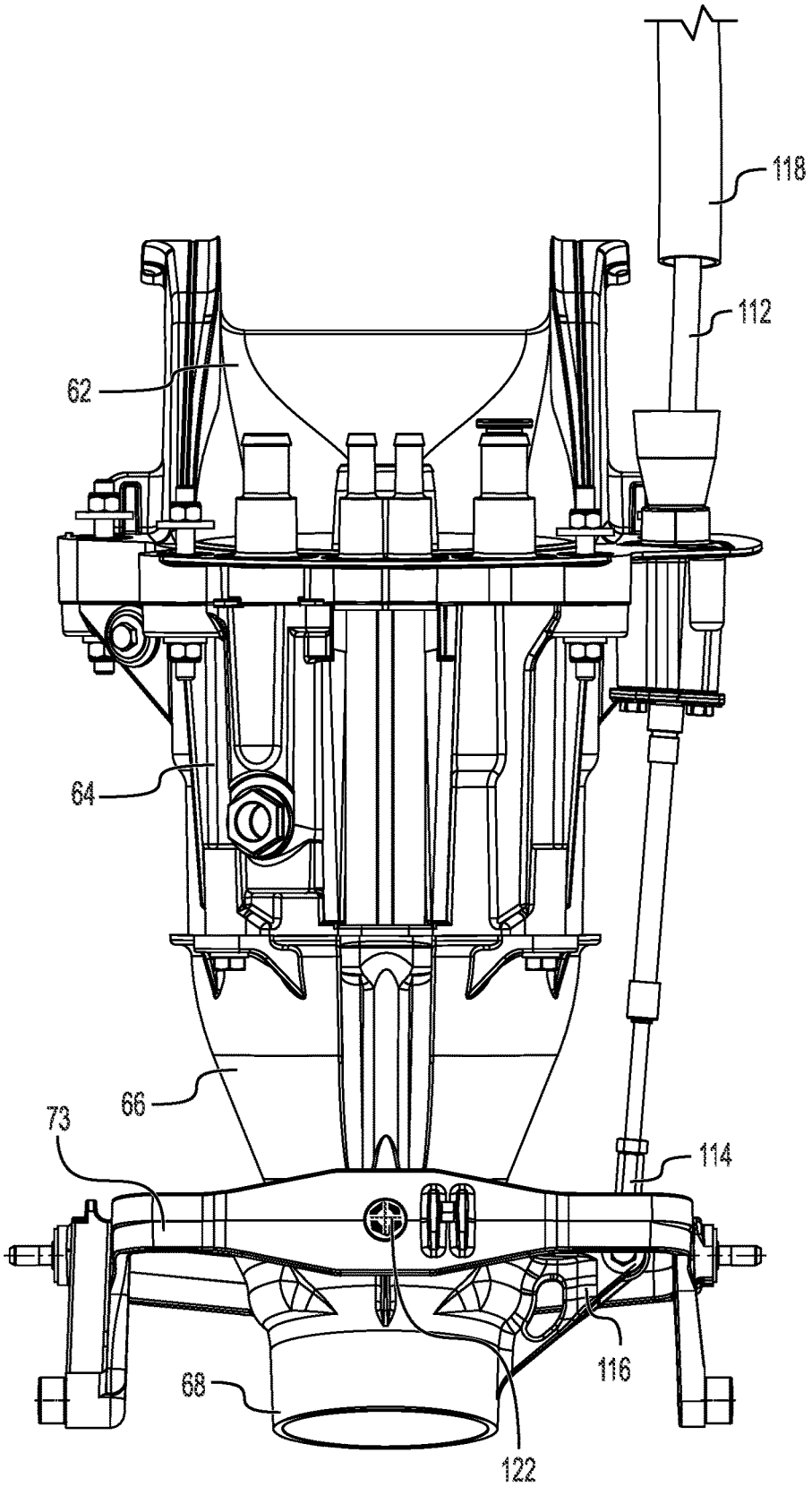
FIG. 5 is a top plan view of a portion a jet propulsion unit of the PWC of FIG. 1, with a steering nozzle oriented to propel the PWC in a straight ahead direction.
Figure 6:
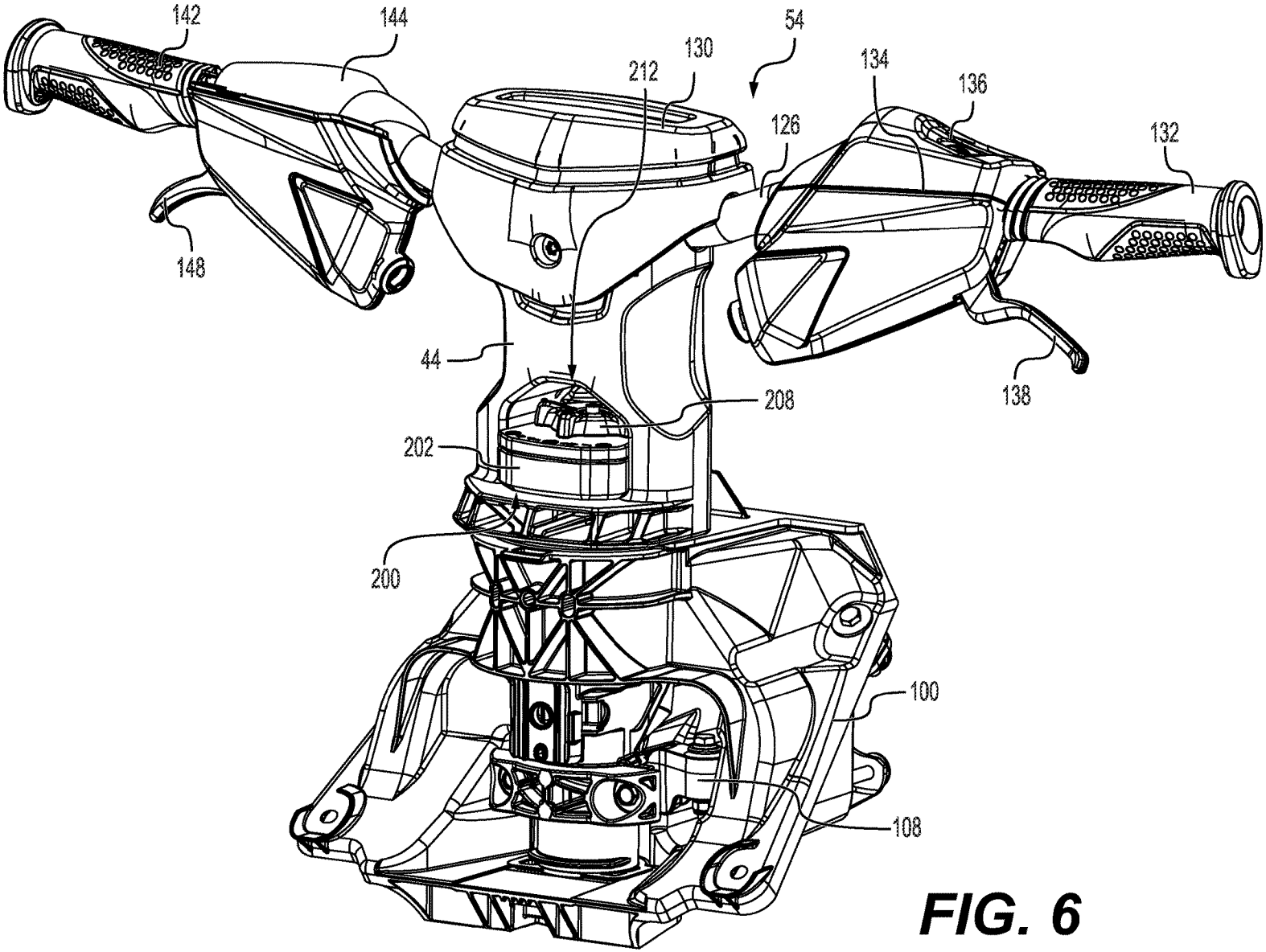
FIG. 6 is a perspective view taken from a front, left side of a portion of the steering system of the PWC of FIG. 1.
Figure 18:
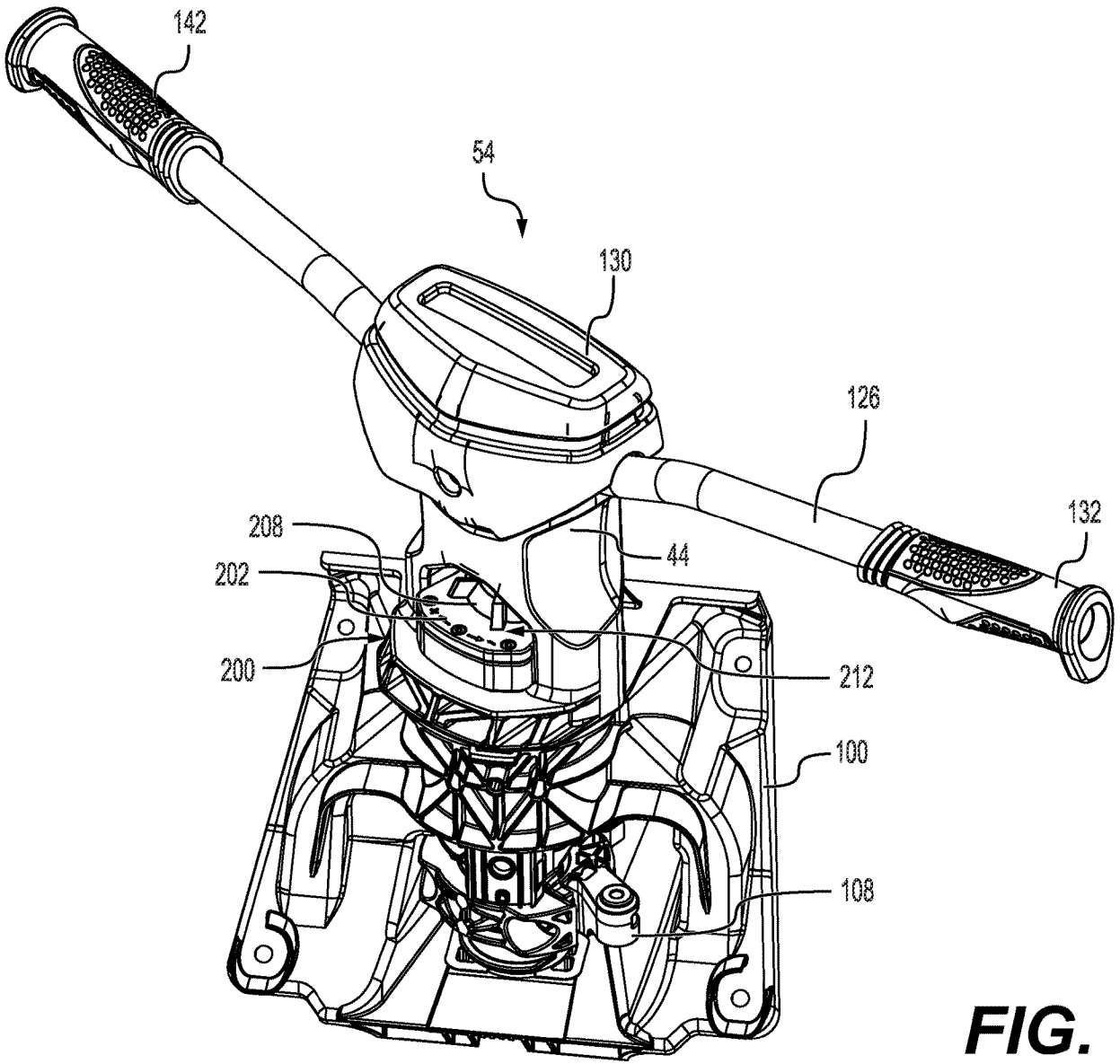
FIG. 18 is a perspective view taken from a front, left side of the portion of the steering system of FIG. 6 with the handlebar turned for making a right turn and with some elements of the portion of the steering system being omitted.
Figure 19:
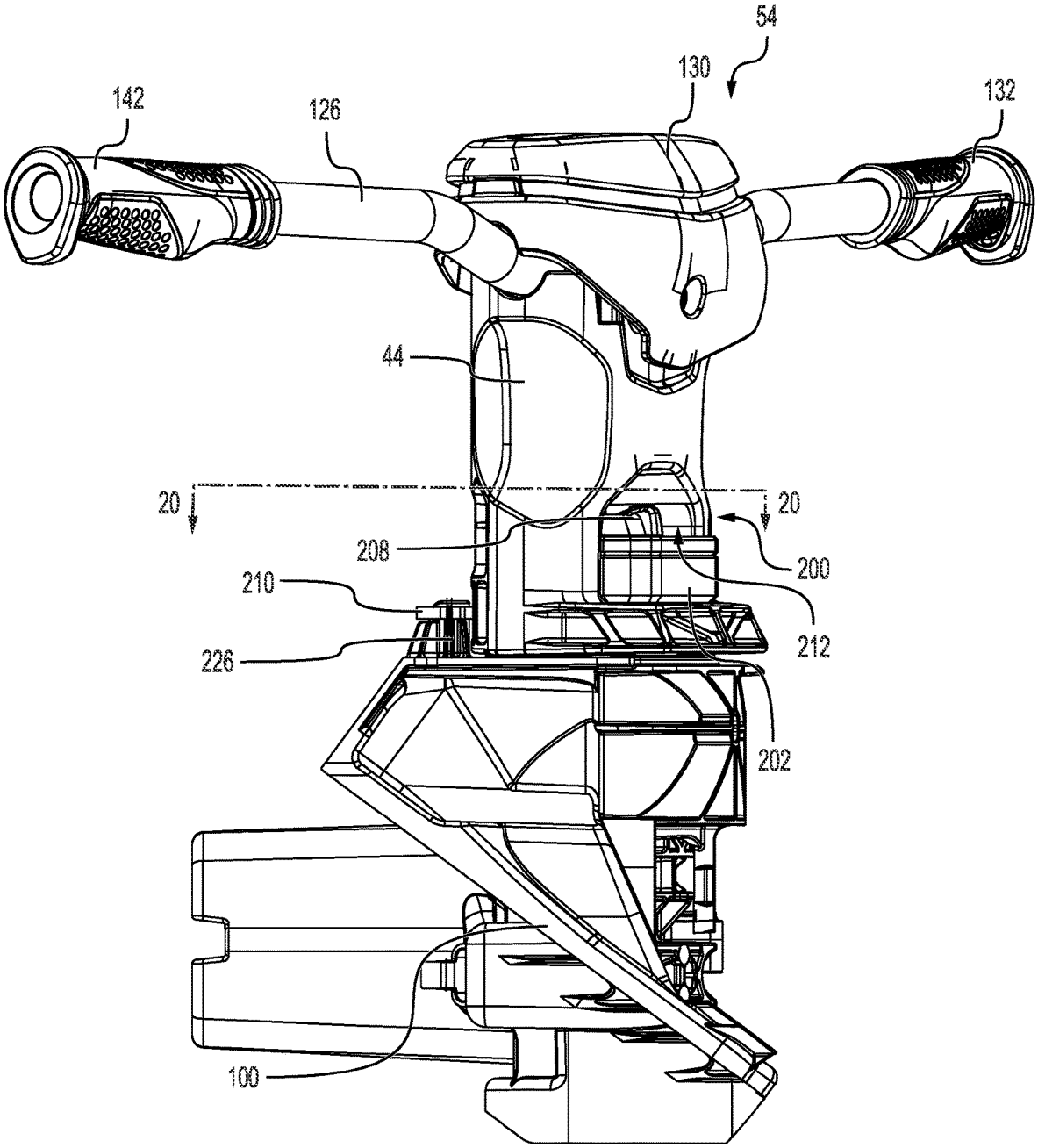
FIG. 19 is a rotated, right side elevation view of the portion of the steering system of FIG. 18.
Figure 20:
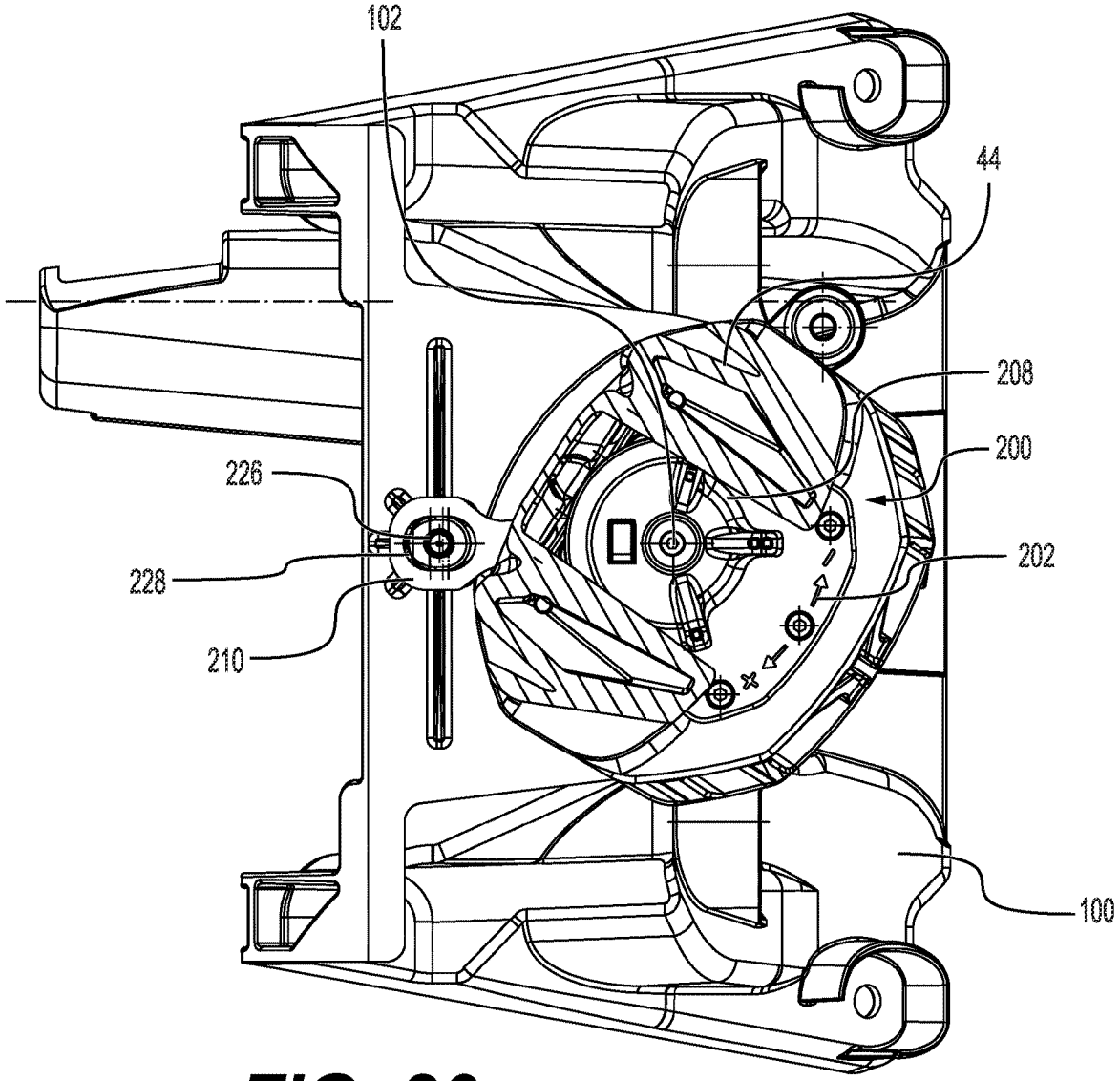
FIG. 20 is a cross-section of the portion of the steering system of FIG. 18 taken through line 20-20 of FIG. 19.
Figure 21:
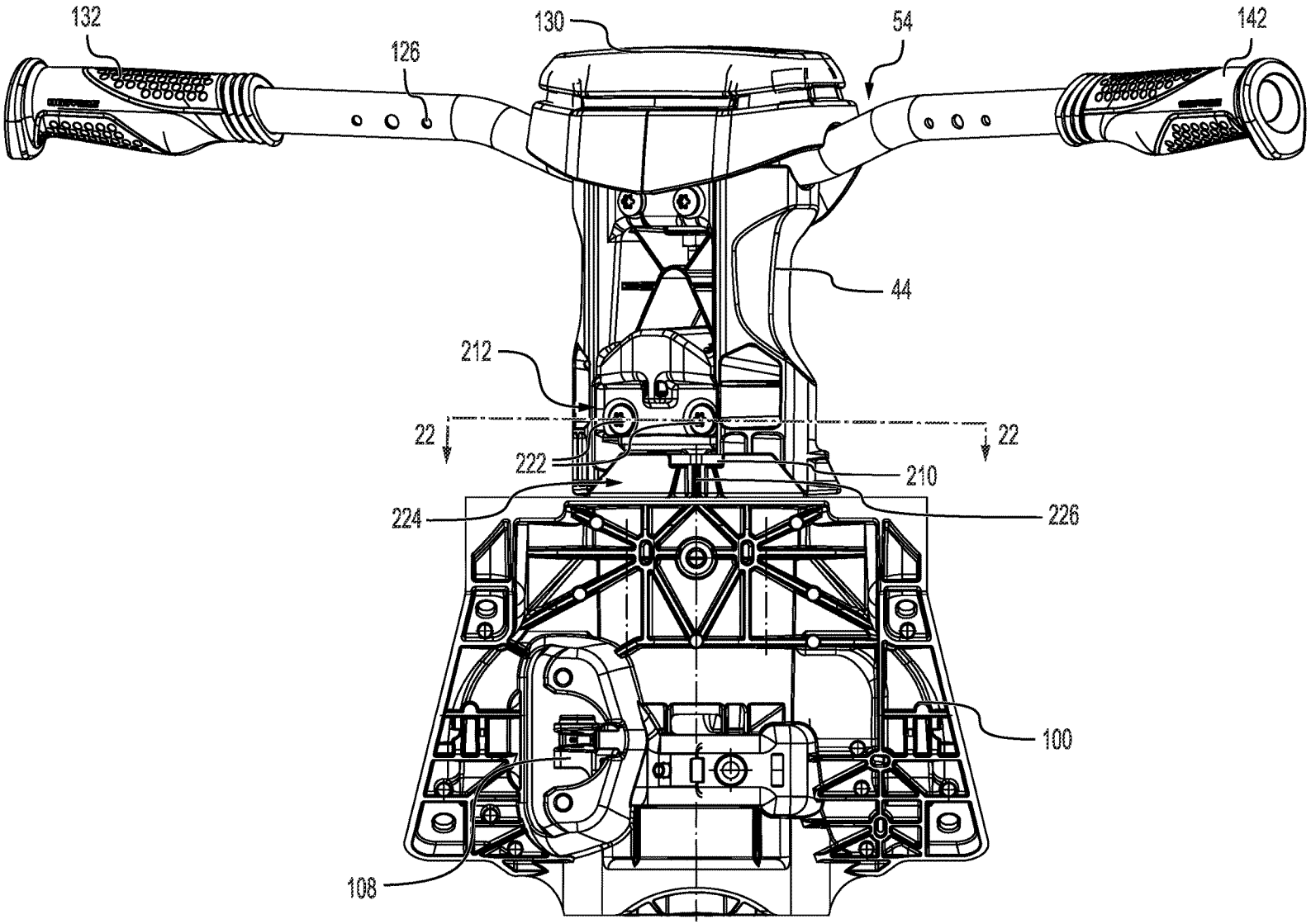
FIG. 21 is a perspective view taken from a bottom, rear side of the portion of the steering system of FIG. 18.
Figure 22:
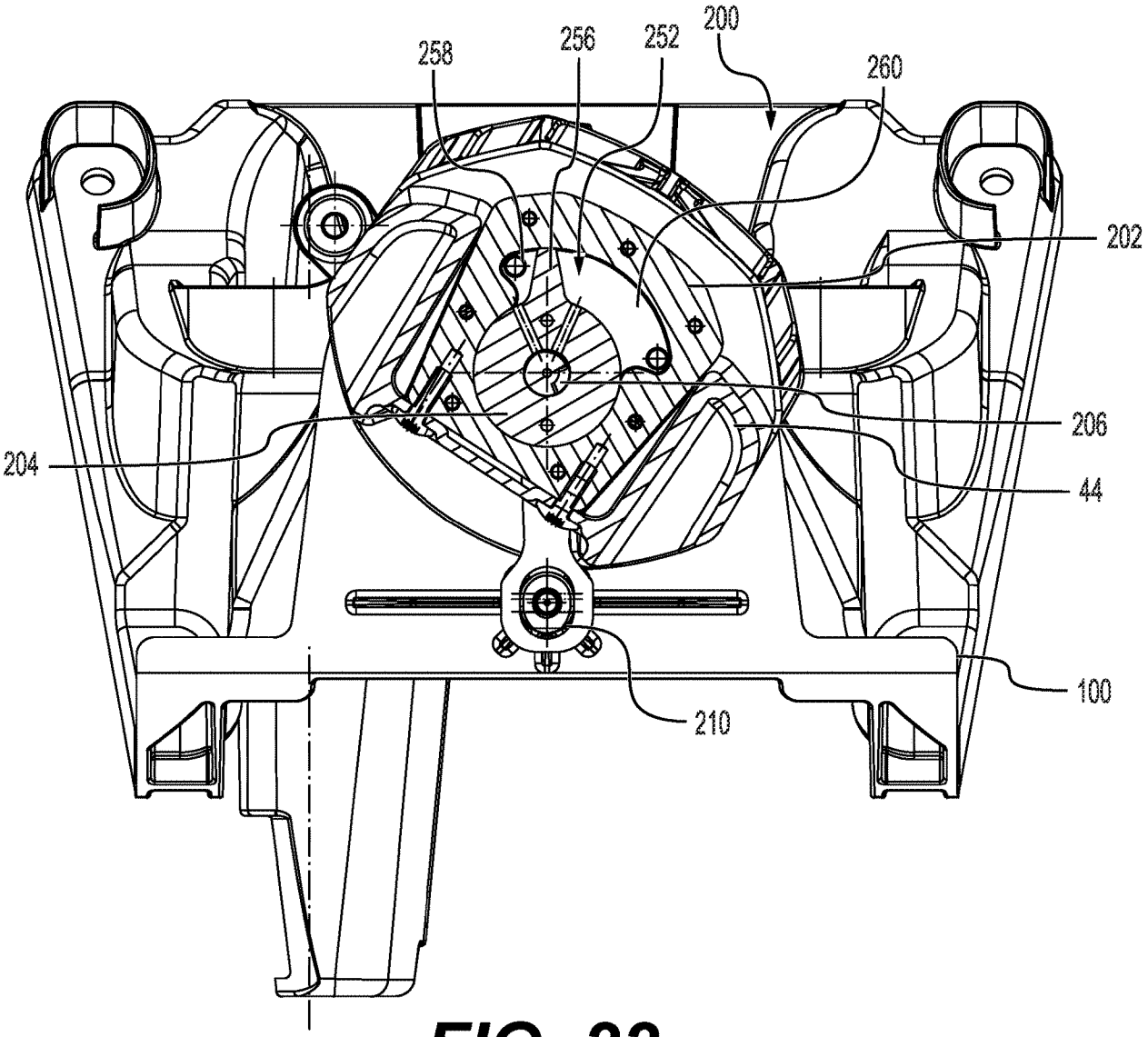
FIG. 22 is a cross-section of the portion of the steering system of FIG. 18 taken through line 22-22 of FIG. 21.

When the handlebar 126 is in a neutral position (i.e. as shown in FIGS. 1 to 3 and 6 to 14), the steering nozzle 68 is straight as shown in FIG. 5. As a result, the PWC 10 is propelled in a straight ahead direction. From the neutral position, when the driver turns the handlebar 126 clockwise (with reference to the driver's point-of-view, as shown in FIGS. 18, 19 and 21), the steering arm 108 pulls the push-pull cable 122, which pulls the nozzle arm 116 forward. As a result, the steering nozzle 68 pivots counter-clockwise (with reference to a top view of the steering nozzle 68, as shown in FIG. 23) and the jet of water expelled from the jet propulsion unit 60 is redirected to steer the PWC 10 to make a right turn. From the neutral position, when the driver turns the handlebar 126 counter-clockwise (with reference to the driver's point-of-view), the steering arm 108 pushes the push-pull cable 122, which pushes the nozzle arm 116 rearward. As a result, the steering nozzle 68 pivots clockwise (with reference to a top view of the steering nozzle 68) and the jet of water expelled from the jet propulsion unit 60 is redirected to steer the PWC 10 to make a left turn.

The steering system is also provided with a steering damper 200. The steering damper 200 has one portion connected to the steering column 44 and which moves with the steering column 44, and another portion connected to the deck 14. More specifically, in the present embodiment, the other portion is connected to the steering column support 100 which is connected to the deck 14. The steering column 44 is pivotable relative to the portion of the steering damper 200 that is connected to the steering column support 100. Also, the portion of the steering damper 200 that is connected to and movable with the steering column 44 is movable relative to the portion of the steering damper 200 that is connected to the steering column support 100. The relative movement between the two portions of the steering damper 200 dampens the pivoting of the steering column 44 about the steering column axis 102, as will be discussed in more detail below. As a result, movements of the handlebar 126 that, in the absence of the steering damper 200, would have resulted in the unwanted steering actions described in the background section of the present application, are now dampened by the steering damper 200, thus reducing small pivoting motions of the steering nozzle 68 about the steering nozzle axis 122 and providing a more precise steering of the PWC 10.

In the present embodiment, the steering damper 200 is a rotary steering damper 200. It is contemplated that in some embodiments, a different type of steering damper 200 could be used. With reference to FIGS. 24 to 30, the steering damper 200 has a housing 202, a stator 204 disposed in the housing 200, a flow limiter 206 disposed in the stator 206, a damping level selector 208 connected to the flow limiter 206, and a damper arm 210 connected to the stator 204. The housing 202 is mounted to the steering column 44 as will be described below, and pivots about the column axis 102 with the steering column 44. The damper arm 210 connects the stator 204 to the steering column support 100, such that as the housing 202 pivots about the column axis 102 with the steering column 44, the housing 202 also pivots relative to the stator 204 about the column axis 102, while the stator 204 remains fixed relative to the steering column support 100 and the remainder of the deck 14. The damping level selector 208 is used to turn the flow limiter 206 inside the stator 204 to adjust a level of damping provided by the steering damper 200 as will be described in more detail below. As the housing 202 pivots about the column axis 102 with the steering column 44, the housing 202 also pivots relative to the flow limiter 206 and the damping level selector 208. The steering damper 200 will be described in more detail below.

With reference to FIGS. 6 to 16, the steering column 44 defines a receptacle 212 at a position between the handlebar 126 and the steering arm 108. The receptacle 212 has a generally forward facing opening when the handlebar 126 is in the neutral position. The steering damper 200 is received in part in the receptacle 212. As such, the steering damper 200 is disposed between the handlebar 126 and the steering column support 100 (see FIG. 6), forward of the seat 30 and the glove box 50, and rearward of the front storage compartment (see FIGS. 1 and 3). Most of the housing 202 is disposed in the receptacle 212, but a front portion of the housing 202 extends forward of the receptacle 212. Part of the damper arm 210 extends rearward of the receptacle 212. The forwardly facing opening of the receptacle 212 provides access to the damping level selector 208.

Figure 7:
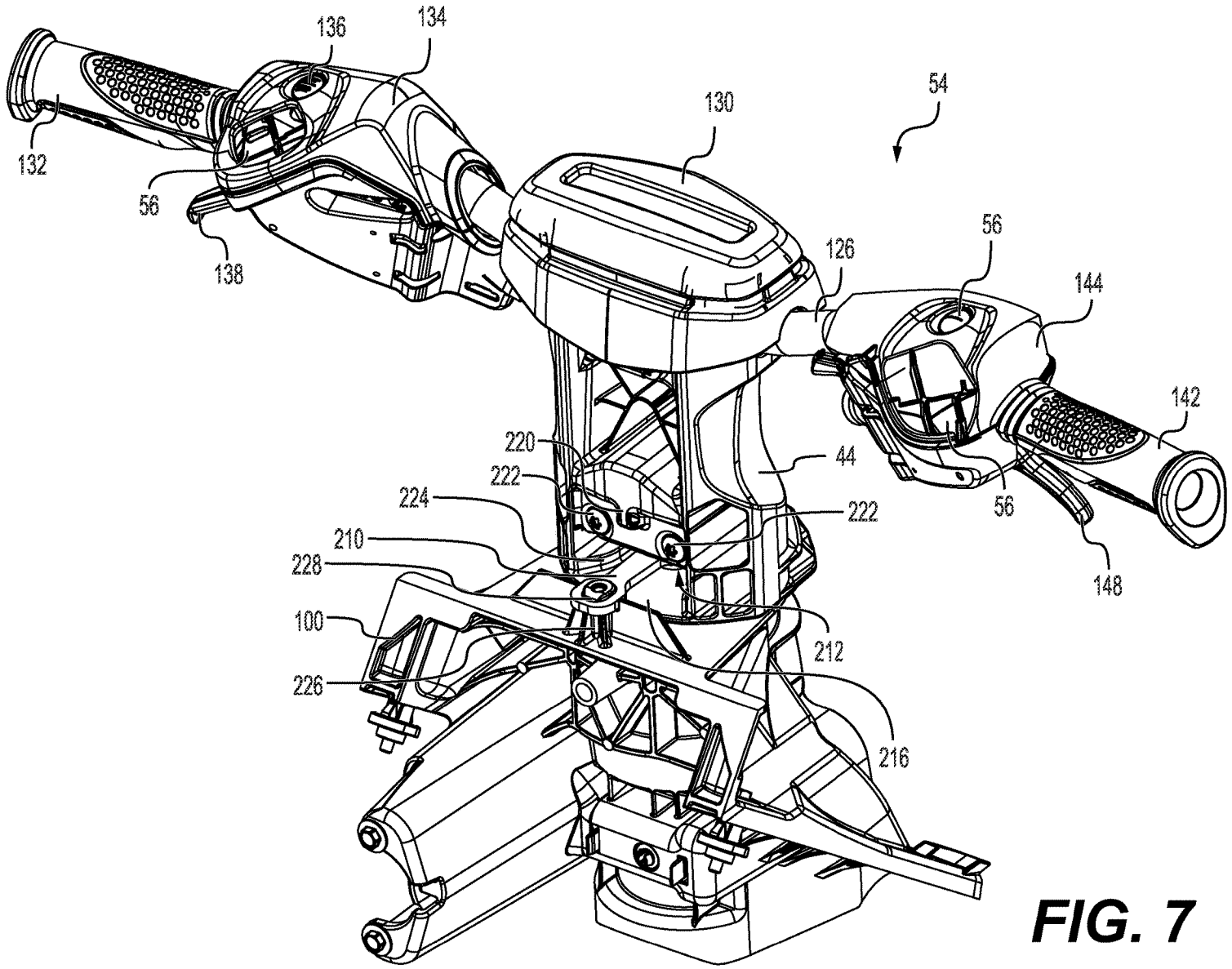
FIG. 7 is a perspective view taken from a rear, right side of the portion of the steering system of FIG. 6.
Figure 8:
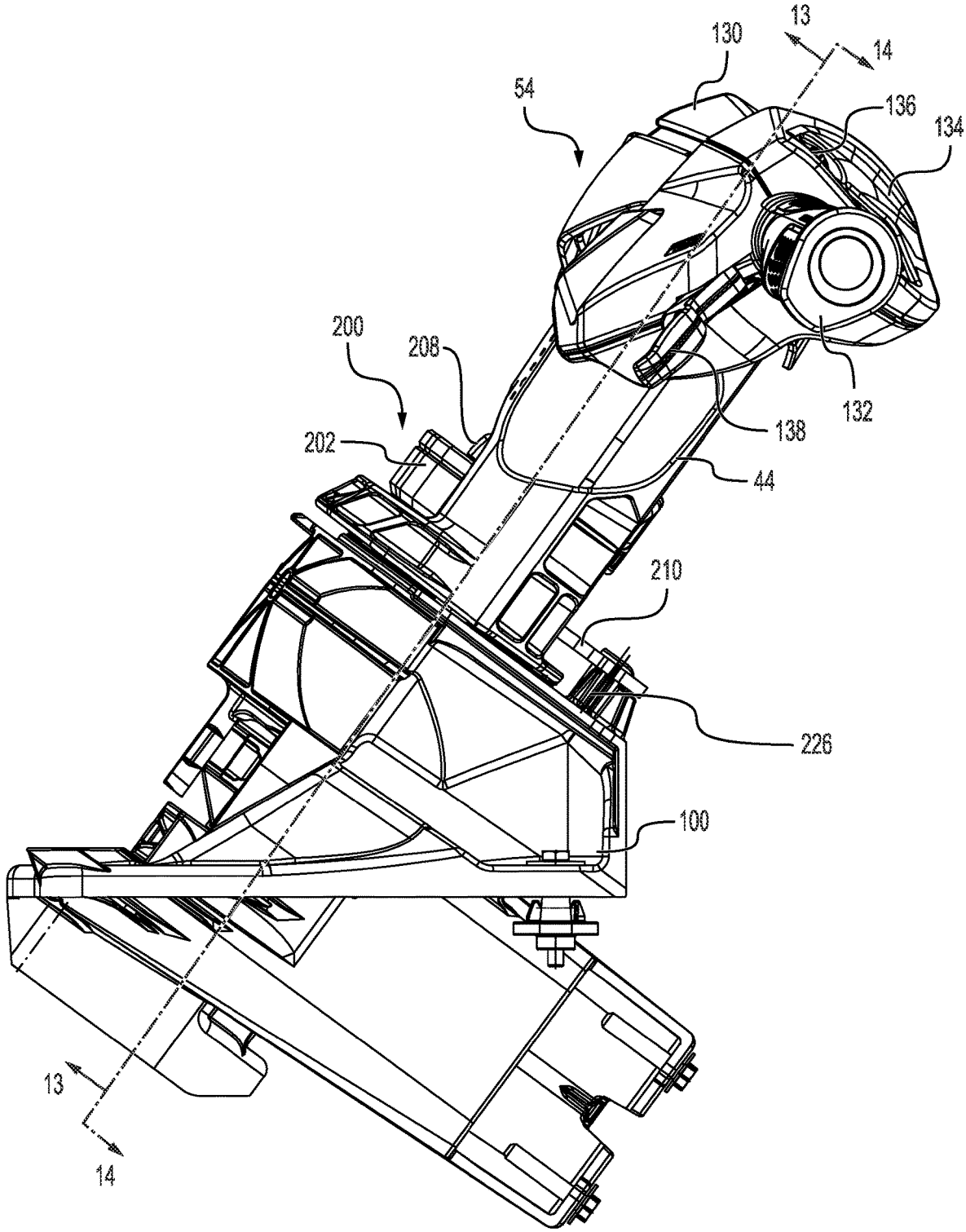
FIG. 8 is a left side elevation view of the portion of the steering system of FIG. 6.
Figure 9:
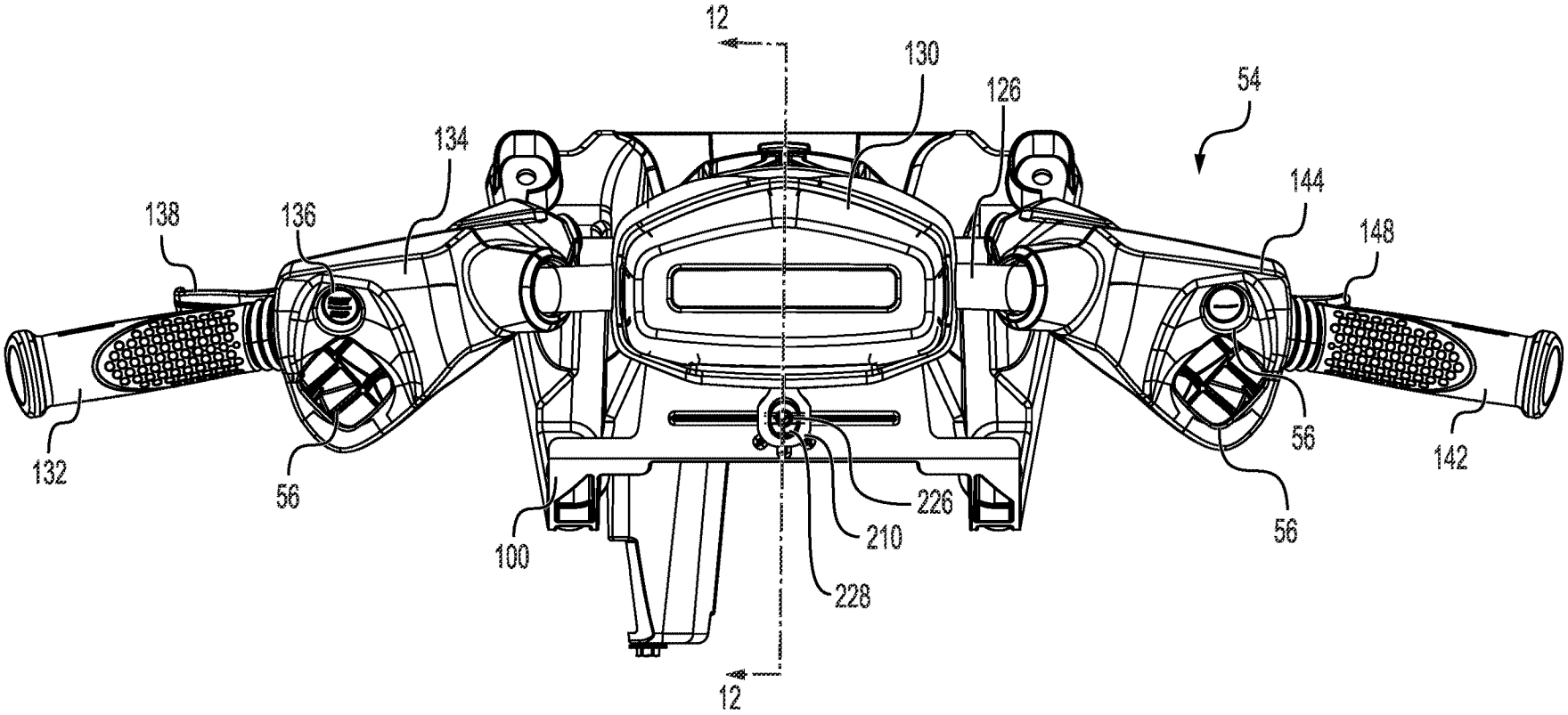
FIG. 9 is a perspective view taken from a top, rear side of the portion of the steering system of FIG. 6.
Figure 15:
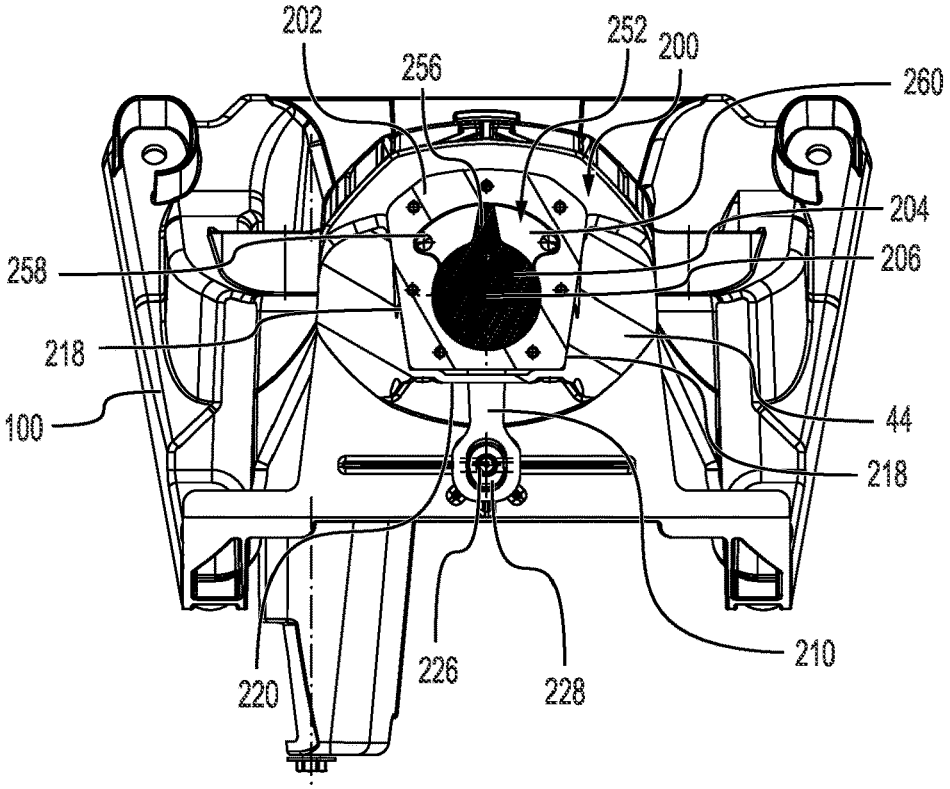
FIG. 15 is a cross-section of the portion of the steering system of FIG. 6 taken through line 15-15 of FIG. 10.
Figure 16:
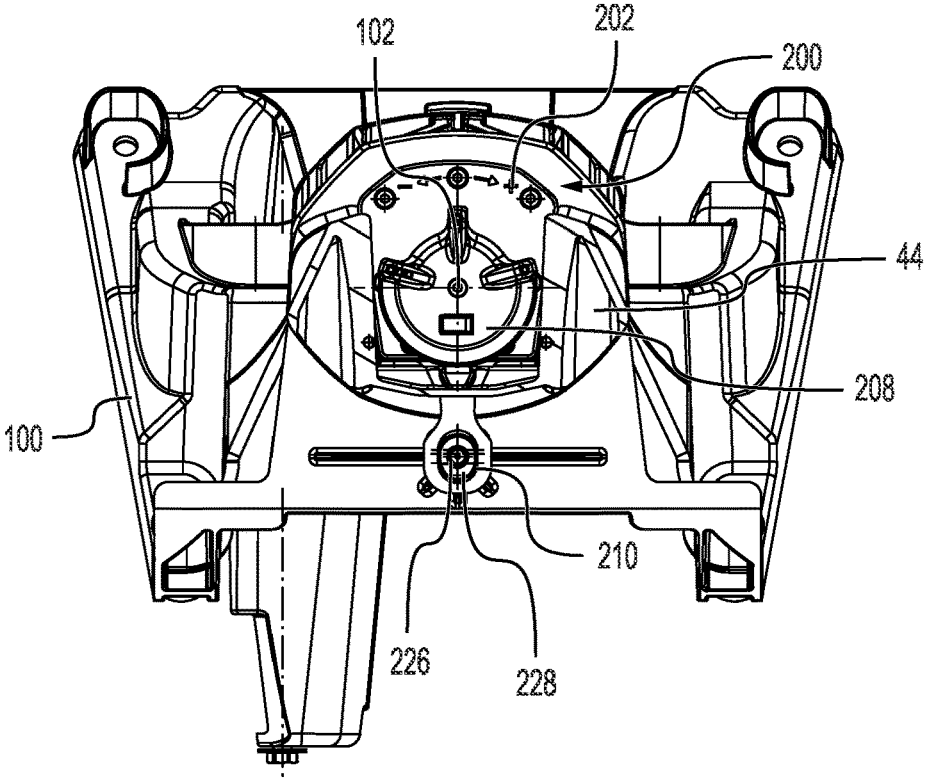
FIG. 16 is a cross-section of the portion of the steering system of FIG. 6 taken through line 16-16 of FIG. 10.
Figure 17:
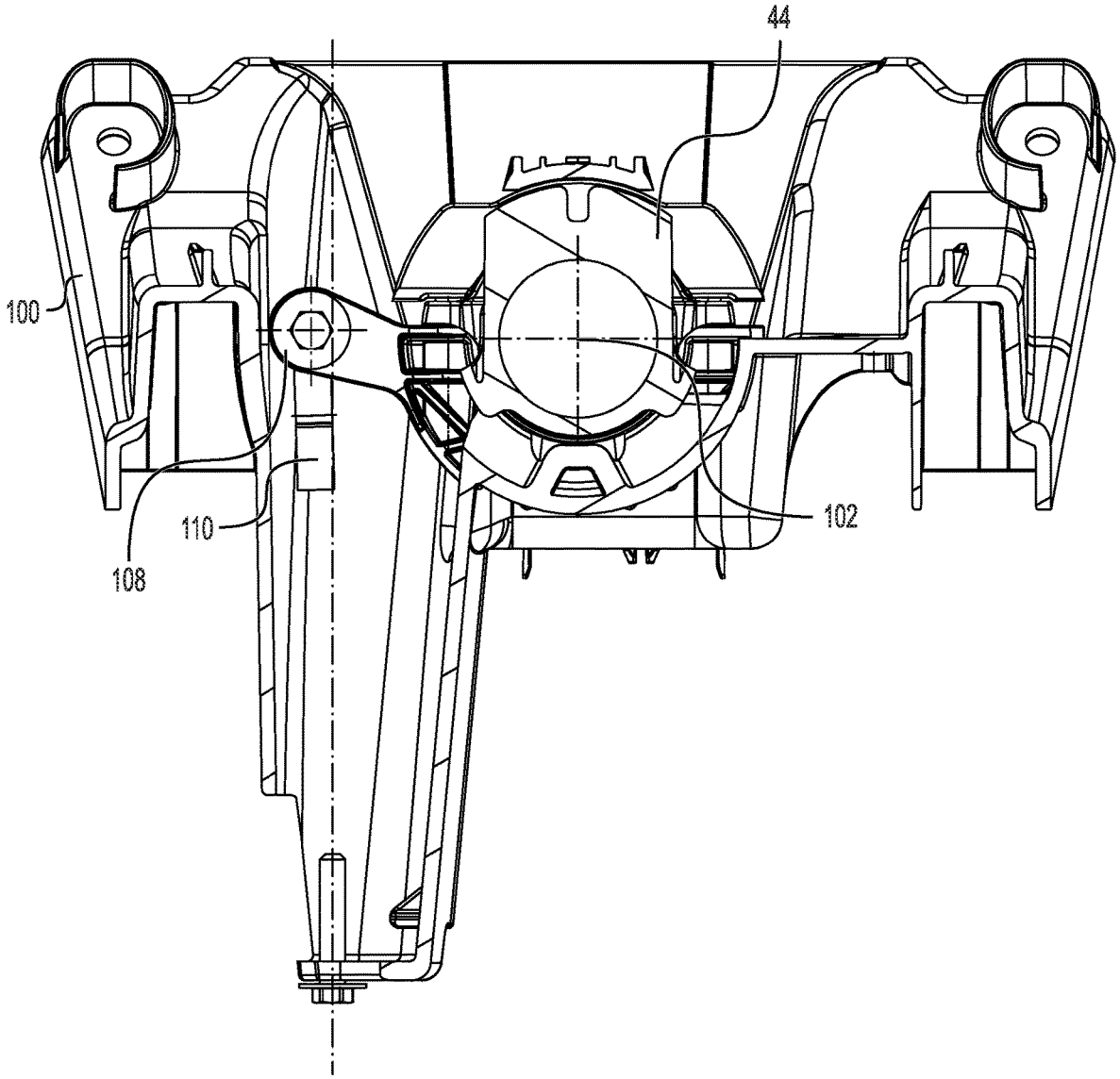
FIG. 17 is a cross-section of the portion of the steering system of FIG. 6 taken through line 17-17 of FIG. 11.

With reference to FIG. 10, the receptacle 212 has a top wall 214, a bottom wall 216, left and right side walls 218 and a rear wall 220. The top wall 214 has an horizontal central portion and inclined side portions. The front ends of the top wall 214, the bottom wall 216 and the side wall 218 define the generally forwardly facing opening of the receptacle, which as can be seen is generally pentagonal in shape. It is contemplated that the generally forwardly facing opening of the receptacle 212 could have another shape. As best seen in FIG. 15, the side walls 218 extend rearward and laterally inward from the generally forwardly facing opening of the receptacle 212 to the rear wall 220. The housing 202 of the steering damper 200 tapers at the same angle as the side walls 218, such that the housing 202 is easily inserted and precisely located in the receptacle 212 and such that the sides of the housing 202 abut the side walls 218. Two fasteners 222 (see FIG. 7) fasten the rear of the housing 202 to the rear wall 220. The receptacle 212 defines an aperture in the rear thereof. As can be seen in FIG. 7, in the present embodiment, the aperture is a gap 224 defined between the lower end of the rear wall 220 of the receptacle 212 and the bottom wall 216 of the receptacle 212. The damper arm 210 extends rearward from the stator 204, under the housing 202 and through the gap 224. The rear portion of the damper arm 210 is connected to the steering column support 100 by a post 226 defined by the steering column support 100 that is received in an aperture 228 defined in the damper arm 210. A fastener 230 fastens a washer 232 to a top of the post 226 to prevent the damper arm 210 from disengaging from the post 226.

Figure 28:
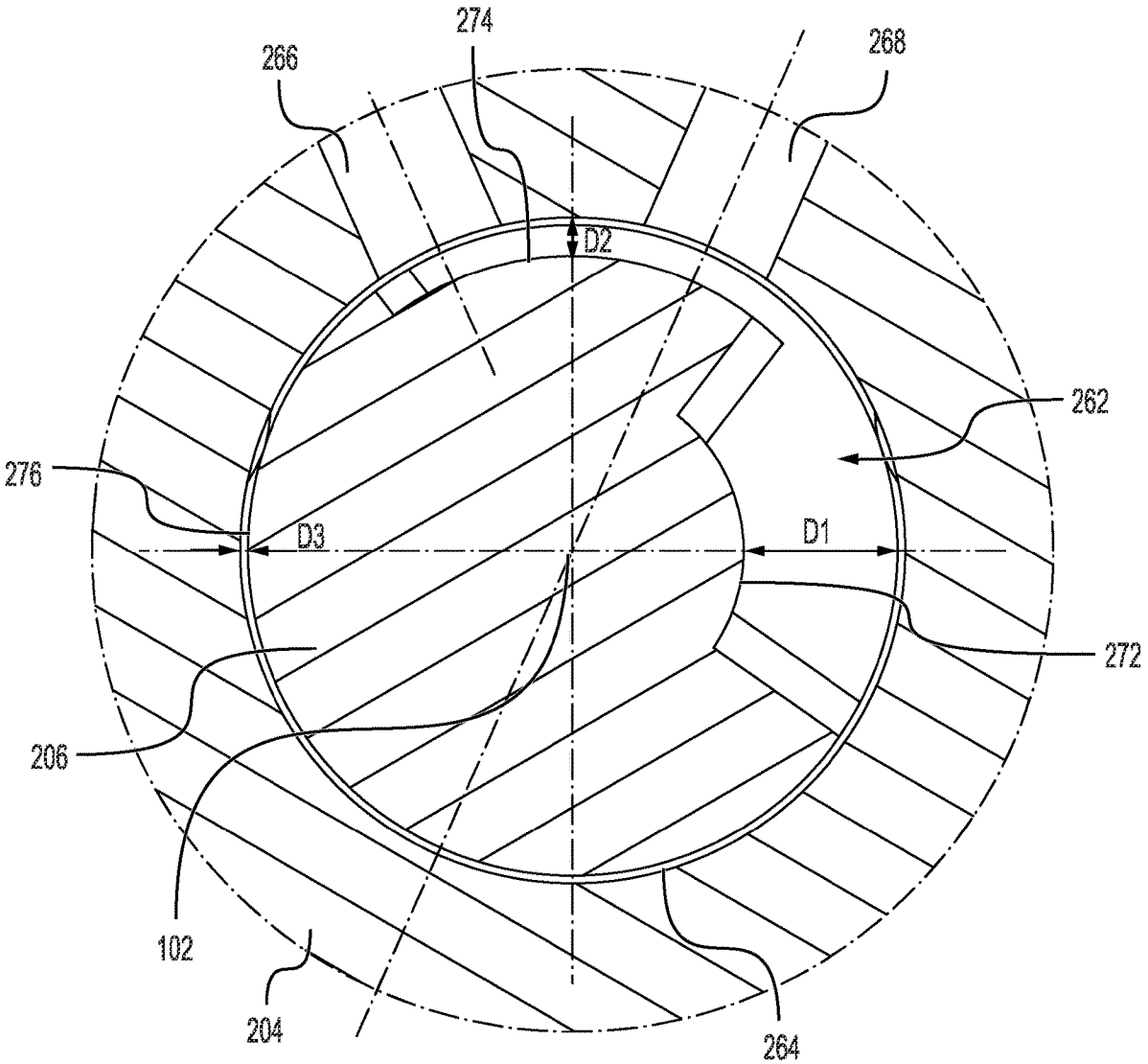
FIG. 28 is a close-up of portion 28 of FIG. 27.
Figure 30:
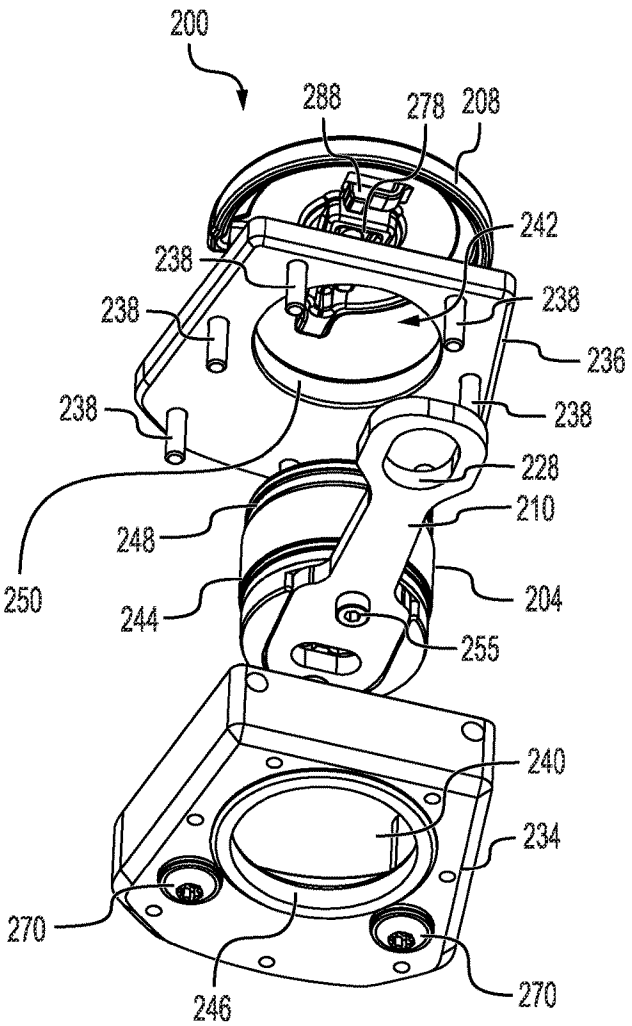
FIG. 30 is an exploded perspective view taken from a bottom, rear, left side of the steering damper of FIG. 24.
Figure 29:
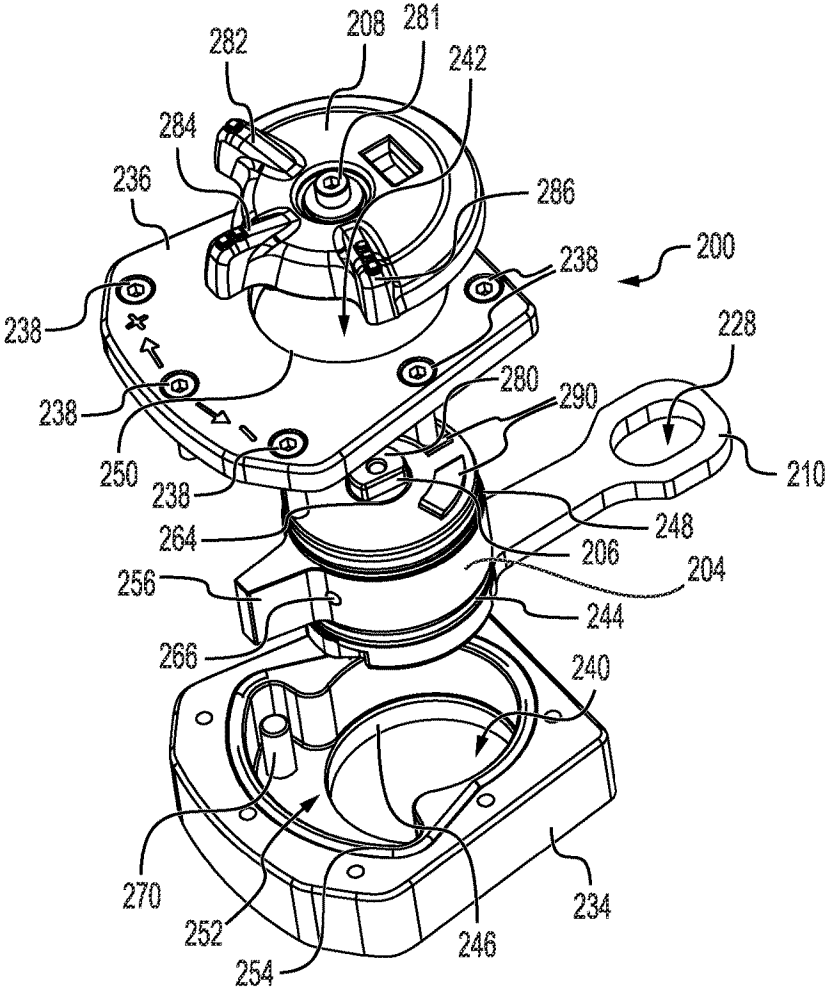
FIG. 29 is an exploded perspective view taken from a top, front, left side of the steering damper of FIG. 24.

Turning back to FIGS. 24 to 30, the steering damper 200 will be described in more detail. The housing 202 has a base 234 and a cover 236. The cover 236 is fastened to the base 234 by fasteners 238. The housing 202 defines a cylindrical passage therein to receive the stator 204. As can be seen in FIGS. 29 and 30, this passage defines a circular opening 240 in the base 234 and a circular opening 242 in the cover 236. The stator 204 extends through the openings 240, 242 and extends below the base 234 and is flush with a top of the cover 236. An O-ring 244 is provided between the stator 204 and the wall 246 defining the opening 240. Another O-ring 248 is provided between the stator 204 and the wall 250 defining the opening 242. The O-rings 244, 248 prevent hydraulic fluid present in the housing 202 from leaking out of the housing 202 via the spaces between the walls 246, 250 and the stator 204. A sector-shaped chamber 252 is defined in the housing 202 in front of the passage receiving the stator 204. A gasket 254 is provided around the passage receiving the stator 204 and the sector-shaped chamber 252 between the base 234 and the cover 236 to prevent hydraulic fluid present in the housing 202 from leaking out of the housing 202 via the interface between the base 234 and the cover 236.

Figure 25:
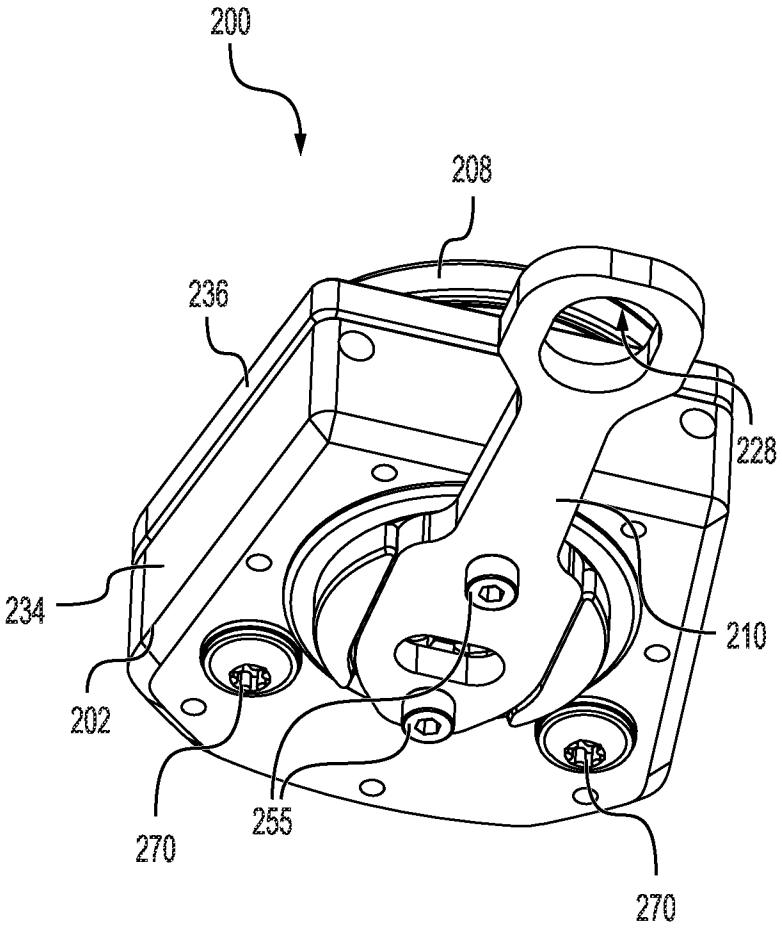
FIG. 25 is a perspective view taken from a bottom, rear, left side of the steering damper of FIG. 24.
Figure 24:
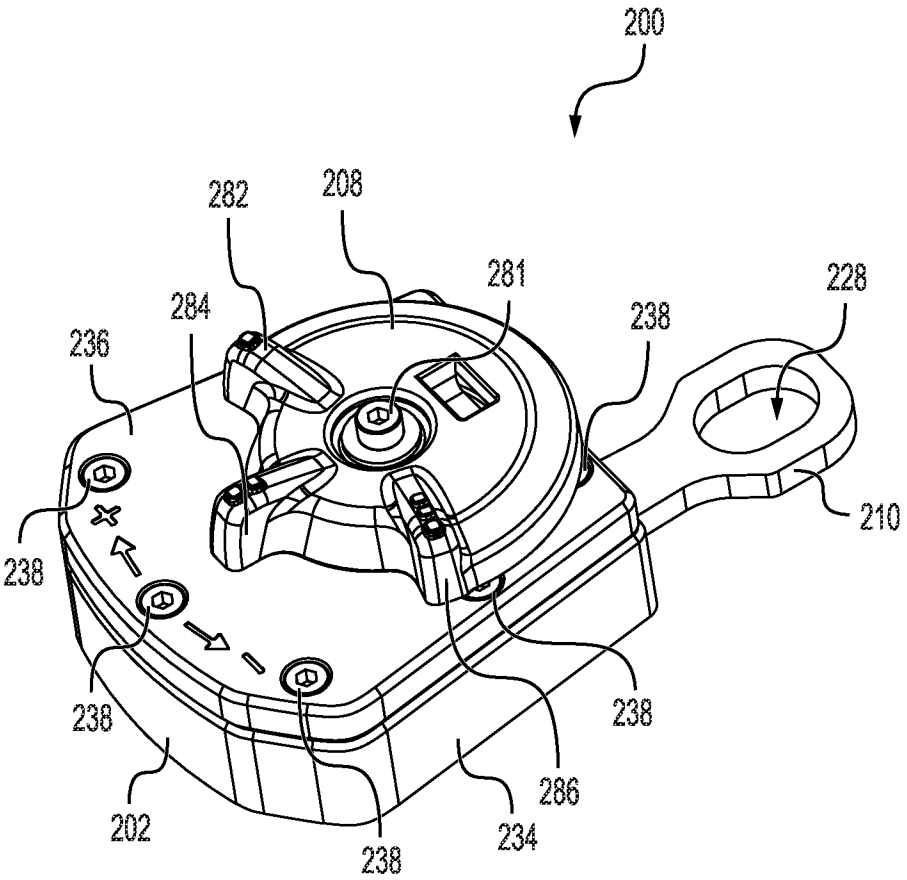
FIG. 24 is a perspective view taken from a top, front, left side of a steering damper of the steering system of the PWC of FIG. 1.
Figure 26:
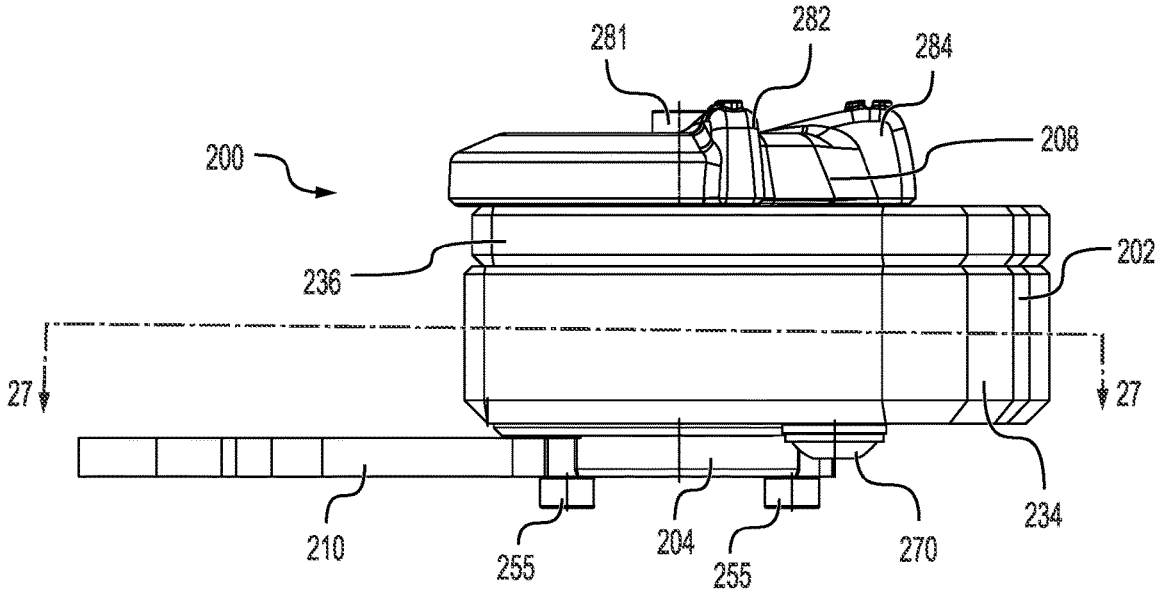
FIG. 26 is a right side elevation view of the steering damper of FIG. 24.
Figure 27:
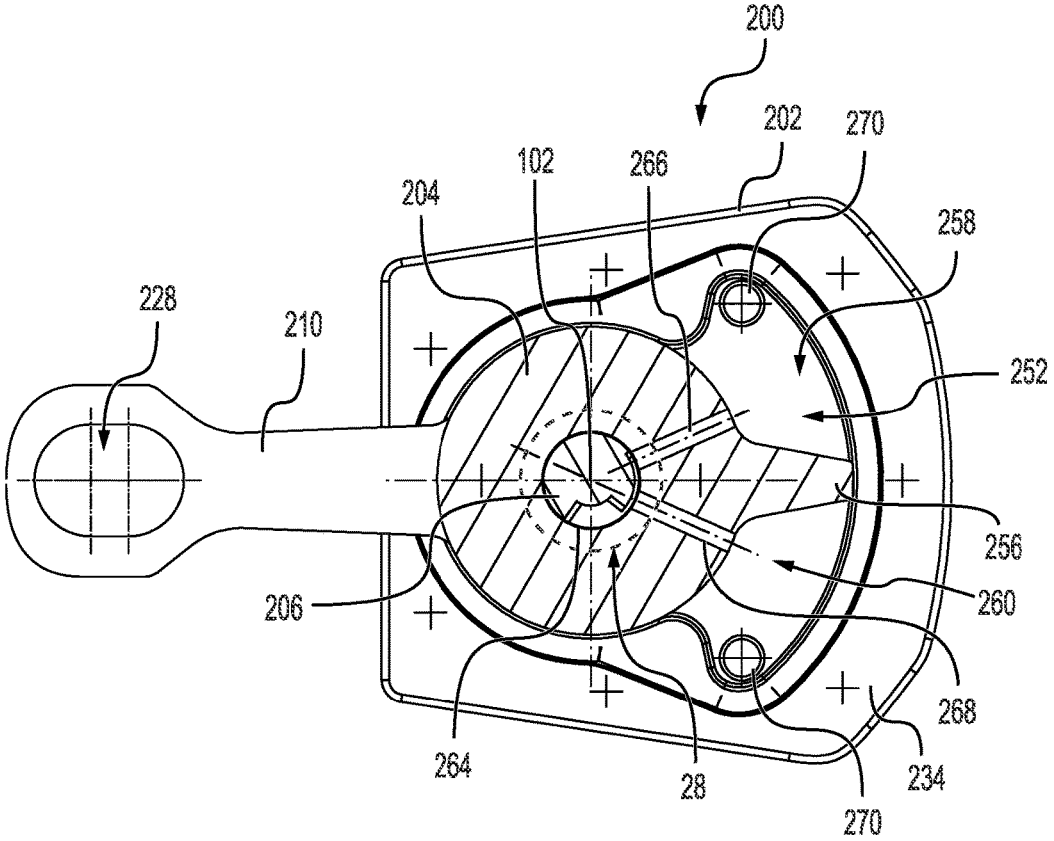
FIG. 27 is a cross-section of the steering damper of FIG. 24 taken through lined 27-27 of FIG. 26.

With reference to FIG. 25, the stator 204 defines a channel in a bottom thereof that receives a front end of the damper arm 210. The damper arm 210 is fastened to the bottom of the stator 204 by two fasteners 255. With reference to FIG. 27, the stator 204 has a paddle 256 that extends forward in the sector-shaped chamber 252, thereby separating the sector-shaped chamber 252 into a left variable volume chamber 258 and a right variable volume chamber 260. The stator 204 defines an inner chamber 262 (FIG. 28) having a cylindrical wall 264. The flow limiter 206 is disposed in the inner chamber 262. The stator 204 also defines left and right passages 266, 268. The left passage 266 opens in the left variable volume chamber 258 and in the inner chamber 262 thereby fluidly communicating the left variable volume chamber 258 with the inner chamber 262. The right passage 268 opens in the right variable volume chamber 260 and in the inner chamber 262 thereby fluidly communicating the right variable volume chamber 260 with the inner chamber 262. The left and right passages 266, 268 fluidly communicate via the inner chamber 262.

In response to the handlebar 126 and the steering column 44 being turned, the housing 202 pivots about the steering column axis 102 as previously described, and the stator 204 stays in position. As a result, fluid in the steering damper 200 flows between the two variable volume chambers 258, 260 via the passages 266, 268 and the inner chamber 262. The diameters of the passages 258, 260 and the flow limiter 206 restrict the flow (i.e. limit the flow rate) of fluid from one variable volume chamber 258, 260 to the other variable volume chambers 258, 260, thereby damping steering actions. Some hydraulic fluid can also flow around the paddle 256 from one variable volume chamber 258, 260 to the other variable volume chambers 258, 260. For example, with reference to FIGS. 15 and 22, in response to turning the handlebar 126 to make a right turn, the housing 202 pivots clockwise (with reference to the orientation of these figures) relative to the stator 204, the left variable volume chamber 258 gets smaller while the right variable volume chamber 260 gets larger. As a result, hydraulic fluid flows from the left variable volume chamber 258, through the passage 266, then through the inner chamber 262, through the passage 268 and then into the right variable volume chamber 260.

With reference to FIGS. 25, 27 and 29, two fasteners 270 are inserted through a bottom of the base 234 and extend inside the sector-shaped chamber 252 near the lateral ends thereof. These fasteners 270 act as stoppers to limit the maximum rotation angle between the housing 202 and the stator 204 by causing the paddle 256 of the stator 204 to abut one of the fasteners 270. The PWC 10 is provided with steering angle limiters (not shown) for limiting the maximum rotation angle of the steering column 44, and this maximum rotation angle is less than the maximum rotation angle provided by the fasteners 270. As such, normally the paddle 256 should not come into contact with the fasteners 270 since the steering column 44 will be stopped before this can happen. However, in the unlikely event that one of the steering angle limiters of the steering column 44 should fail, the contact between the paddle 256 and one of the fasteners 270 will act as a backup steering angle limiter.

The flow limiter 206 has three different positions, each of which corresponds to a different level of flow restriction between the passages 266, 268, and therefore to a different level of damping by the steering damper 200. In the present embodiment, the flow limiter 206 is a stepped cylinder 206 having three steps 272, 274, 276. As best seen in FIG. 28, the step 272 is at a distance D1 from the wall 264 of the inner chamber 262, the step 274 is at a distance D2 from the wall 264 which is less than the distance D1, and the step 276 is at a distance D3 from the wall 264 which is less than the distance D2. To adjust the level of damping of the steering damper 200, the stepped cylinder 206 is turned to align one of the steps 272, 274, 276 with the ends of the passages 266, 268 opening into the inner chamber 262 (i.e. placing the desired step 272, 274, 276 is alignment with the paddle 256). The closer the selected step 272, 274, 276 is to the wall 264, the more the flow of fluid between the passages 266, 268 is restricted, and therefore the more damping the steering damper 200 provides. In the present embodiment, the step 276 provides the most damping and the step 272 provides the least damping. In the figures, the step 274 is selected, which provides a level of damping that is between the levels of damping provided by the steps 272, 276. It is contemplated that the stepped cylinder 206 could have only two steps, or more than three steps. It is also contemplated that an outer surface the flow limiter 206 could have the shape of a segment of a spiral thereby permitting gradual adjustments for any level of damping between a maximum and a minimum level. It is also contemplated that in some embodiments, the flow limiter 206 could be omitted, in which case the flow restriction would be provided by the diameters of the passages 258, 260 and the flow around the paddle 256, thus resulting in a steering damper 200 having a single level of damping.

The damping level selector 208 is used to turn the stepped cylinder 206 between its three positions. In the present embodiment, the damping level selector 208 is a knob 208 disposed on top of the housing 202. With reference to FIGS. 29 and 30, the knob 208 has a recess 278 that receives a post 280 extending from a top of the stepped cylinder 206. A fastener 281 fastens the knob 208 to the post 280. The knob 208 has three arms 282, 284, 286, each being identified by a different number of protruding dots (one, two or three dots). Turning the knob 208 such that the arm 282, having one dot, extends longitudinally (i.e. points toward the front) aligns the step 272 with the passages 266, 268, and therefore provides the least amount of damping. Turning the knob 208 such that the arm 284, having two dots, extends longitudinally (i.e. points toward the front) aligns the step 274 with the passages 266, 268, and therefore provides the intermediate amount of damping. Turning the knob 208 such that the arm 286, having three dots, extends longitudinally (i.e. points toward the front) aligns the step 276 with the passages 266, 268, and therefore provides the most amount of damping. It is contemplated that knob 208 could have other kinds of identifications to help the user select the desired level of damping. The knob 208 also has a resilient arm 288 (FIG. 30). The stator 204 has two arcuate bumps 290 of top thereof. The end of the resilient arm 288 is between the two bumps 290 when the arm 284 points toward the front. To turn the knob 208, and therefore the stepped cylinder 206 to one of the other two positions, the end of the resilient arm 288 has to travel over one of the bumps 290, thereby providing a tactile feedback to the user turning the know 208 that the desired position has been reached once the resilient arm 288 has passed the bump 290.

Modifications and improvements to the above-described embodiments of the present technology may become apparent to those skilled in the art. The foregoing description is intended to be exemplary rather than limiting. The scope of the present technology is therefore intended to be limited solely by the appended claims.

What is claimed is:

1. A personal watercraft comprising:
a hull;
a deck disposed on the hull, the deck defining:
a pedestal at a lateral center of the deck;
a left gunnel on a left side of the deck;
a left footrest laterally between the left gunnel and the pedestal;
a right gunnel on a right side of the deck;
a right footrest laterally between the right gunnel and the pedestal; and
a reboarding platform at least in part rearward of the pedestal,
the hull and the deck defining a volume therebetween;
a straddle seat connected to the pedestal;
a motor disposed in the volume;
a jet propulsion unit operatively connected to and driven by the motor, the jet propulsion unit comprising:
a jet pump;
a venturi connected to the jet pump; and
a steering nozzle pivotally connected to the venturi, the steering nozzle being pivotable about a steering nozzle axis to steer the personal watercraft, the steering nozzle having a nozzle arm;
a steering column support connected to the deck;
a steering column pivotally connected to the steering column support, the steering column being pivotable about a steering column axis;
a handlebar connected to an upper portion of the steering column;
a steering arm connected to a lower portion of the steering column;
a push-pull cable connected between the steering arm and the nozzle arm such that pivoting of the steering column about the steering column axis pivots the steering nozzle about the steering nozzle axis; and
a steering damper disposed between the handlebar and the steering column support, the steering damper comprising:
a first portion connected to the steering column and being movable with the steering column; and
a second portion connected to the steering column support, the steering column being pivotable relative to the second portion, the first portion being movable relative to the second portion, movement of the first portion relative to the second portion damping pivoting of the steering column about the steering column axis.

2. The personal watercraft of claim 1, wherein:
the steering damper is a rotary steering damper;
the first portion is a housing of the rotary steering damper;
the housing being mounted to and pivoting with the steering column about the steering column axis;
the second portion is a stator of the rotary steering damper;
the stator is disposed in the housing; and
the housing pivots relative to the stator about the steering column axis.

3. The personal watercraft of claim 2, wherein:
the steering column defines a receptacle;
the receptacle is disposed between the handlebar and the steering arm; and
the housing is received at least in part in the receptacle.

4. The personal watercraft of claim 3, wherein:
the receptacle has:
a top wall;
a bottom wall;
a left side wall;
a right side wall; and
a rear wall; and
the top wall, the bottom wall, the left side wall and the right side wall define a generally forwardly facing opening.

5. The personal watercraft of claim 4, wherein the generally forwardly facing opening is generally pentagonal.

6. The personal watercraft of claim 4, wherein:
the left side wall and the right side wall extend rearward and laterally inward from the generally forwardly facing opening to the rear wall; and
the housing tapers such that sides of the housing abut the left side wall and the right side wall.

7. The personal watercraft of claim 4, wherein:
the receptacle defines an aperture in a rear thereof;
the rotary damper further comprises a damper arm connecting the stator to the steering column support;
the damper arm extends rearward from the stator and through the aperture.

8. The personal watercraft of claim 7, wherein the aperture is a gap defined between the rear wall of the receptacle and the bottom wall of the receptacle.

9. The personal watercraft of claim 2, wherein:
the housing and the stator define a first variable volume chamber and a second variable volume chamber; and in response to pivoting of the housing relative to the stator, fluid flows between the first and second variable volume chambers.

10. The personal watercraft of claim 9, wherein:

the housing defines a sector-shaped chamber;

the stator has a paddle extending in the sector-shaped chamber;

the paddle separating the sector-shaped chamber into the first variable volume chamber and the second variable volume chamber;

the stator defines a first passage opening into the first variable volume chamber and a second passage opening into the second variable volume chamber;

the first passage fluidly communicating with the second passage such that in response to pivoting of the housing relative to the stator, fluid flows between the first and second variable volume chambers via the first and second passages.

11. The personal watercraft of claim 10, wherein:

the stator defines an inner chamber fluidly communicating the first passage with the second passage;

the rotary damper further comprises a flow limiter disposed in the inner chamber; and the flow limiter has at least a first position and a second position, the flow limiter restricting a flow of fluid between the first and second passages more in the first position than in the second position.

12. The personal watercraft of claim 11, wherein:

the inner chamber has a cylindrical wall;

the flow limiter is a stepped cylinder having a first step and a second step;

the first step is closer to the cylindrical wall than the second step;

in the first position of the flow limiter, the first step is aligned with ends of the first and second passages opening into the inner chamber;

in the second position of the flow limiter, the second step is aligned with the ends of the first and second passages opening into the inner chamber; and the stepped cylinder is turned between the first and second positions.

13. The personal watercraft of claim 12, wherein the rotary damper further comprises a damping level selector connected to the stepped cylinder to turn the stepped cylinder, the damping level selector being disposed on top of the housing.

14. The personal watercraft of claim 11, wherein the flow limiter has a third position, the flow limiter restricting a flow of fluid between the first and second passages more in the second position than in the third position.

15. The personal watercraft of claim 9, wherein the rotary damper further comprises a damper arm connecting the stator to the steering column support.

16. The personal watercraft of claim 15, wherein the damper arm extends rearward from the stator under the housing.

17. The personal watercraft of claim 9, wherein the fluid is hydraulic fluid.

18. The personal watercraft of claim 1, wherein:

the steering column defines a receptacle;

the receptacle is disposed between the handlebar and the steering arm; and the steering damper is received at least in part in the receptacle.

19. The personal watercraft of claim 1, further comprising a front storage compartment in front of the steering column; and wherein the steering damper is forward of the straddle seat and rearward of the front storage compartment.

20. The personal watercraft of claim 19, further comprising a glove box longitudinally between the steering column and the straddle seat; and wherein the steering damper is forward of the glove box.

21. A personal watercraft comprising:

a hull;

a deck disposed on the hull, the deck defining:

a pedestal at a lateral center of the deck;

a left gunnel on a left side of the deck;

a left footrest laterally between the left gunnel and the pedestal;

a right gunnel on a right side of the deck;

a right footrest laterally between the right gunnel and the pedestal; and a reboarding platform at least in part rearward of the pedestal, the hull and the deck defining a volume therebetween;

a straddle seat connected to the pedestal;

a motor disposed in the volume;

a jet propulsion unit operatively connected to and driven by the motor, the jet propulsion unit comprising:

a jet pump;

a venturi connected to the jet pump; and a steering nozzle pivotally connected to the venturi, the steering nozzle being pivotable about a steering nozzle axis to steer the personal watercraft, the steering nozzle have a nozzle arm;

a steering column pivotally connected to the deck, the steering column being pivotable about a steering column axis;

a handlebar connected to an upper portion of the steering column;

a steering arm connected to a lower portion of the steering column;

a push-pull cable connected between the steering arm and the nozzle arm such that pivoting of the steering column about the steering column axis pivots the steering nozzle about the steering nozzle axis, the steering column defining a receptacle between the handlebar and the steering arm, the receptacle having a generally forwardly facing opening; and a steering damper disposed at least in part in the receptacle, the steering damper comprising:

a first portion connected to the steering column and being movable with the steering column;

a second portion connected to the deck, the steering column being pivotable relative to the second portion, the first portion being movable relative to the second portion, movement of the first portion relative to the second portion damping pivoting of the steering column about the steering column axis; and a damping level selector adjusting a level of damping provided by the steering damper, the generally forwardly facing opening of the receptacle providing access to the damping level selector.

* * * * *